US011208125B2

(12) United States Patent
Thiyagarajan et al.

(10) Patent No.: US 11,208,125 B2
(45) Date of Patent: Dec. 28, 2021

(54) VEHICLE CONTROL SYSTEM

(71) Applicant: GE Global Sourcing LLC, Norwalk, CT (US)

(72) Inventors: Saravanan Thiyagarajan, Bangalore (IN); Ankit Sharma, Bangalore (IN); Prakarsh Paritosh, Bangalore (IN); David Allen Eldredge, Melbourne, FL (US); William Cherrick Schoonmaker, Melbourne, FL (US); Kaitlyn Ann Hrdlicka, Lawrence Park, PA (US); Joseph Daniel Wakeman, Lawrence Park, PA (US)

(73) Assignee: transportation ip holdings, llc, Norwalk, CT (US)

( * ) Notice: Subject to any disclaimer, the term of this patent is extended or adjusted under 35 U.S.C. 154(b) by 197 days.

(21) Appl. No.: 16/262,438

(22) Filed: Jan. 30, 2019

(65) Prior Publication Data

US 2019/0161100 A1 May 30, 2019

Related U.S. Application Data

(63) Continuation-in-part of application No. PCT/US2017/042516, filed on Jul. 18, 2017, which is (Continued)

(51) Int. Cl.

| | |
|---|---|
| ***B61L 3/00*** | (2006.01) |
| ***B61L 27/00*** | (2006.01) |
| ***B61L 3/02*** | (2006.01) |

(52) U.S. Cl.

CPC ..... *B61L 3/006* (2013.01); *B61L 3/008* (2013.01); *B61L 3/02* (2013.01); *B61L 27/0022* (2013.01)

(58) Field of Classification Search

CPC .. B61L 3/006; B61L 3/008; B61L 3/02; B61L 27/0022

(Continued)

(56) References Cited

U.S. PATENT DOCUMENTS 1,730,323 A * 10/1929 Howe ..... B61L 3/02 246/39
RE17,678 E * 5/1930 Hudd ..... B61L 3/02 246/178

(Continued)

FOREIGN PATENT DOCUMENTS

JP 6402104 B2 * 10/2018 ..... B60W 10/06
WO 2010078133 A1 7/2010
WO WO-2018160724 A1 * 9/2018 ..... G05D 1/0088

OTHER PUBLICATIONS

International Search Report and Written Opinion issued in connection with corresponding PCT Application No. PCT/US2017/042516 dated Oct. 18, 2017.

*Primary Examiner* — Atul Trivedi
(74) *Attorney, Agent, or Firm* — The Small Patent Law Group LLC; Jason P. Gross

(57) ABSTRACT

A control system dictates operational settings of a rail vehicle system based a transitory second speed limit that is no faster than a current first speed limit and which is issued for a determined segment of the track for a determined time period. The control system obtains a current time, determines whether the transitory second speed limit has started, is in effect, or has expired based on the current time relative to the determined time period, and, in response to such determination, performs one or more of (a) generate a prompt to indicate that the determined time period has expired, (b) operate the rail vehicle system at the first speed limit, and/or (c) modify the operational settings of the rail vehicle system to exceed the second speed limit in the (Continued)

determined segment but not exceed the first speed limit for the determined segment.

21 Claims, 4 Drawing Sheets

Related U.S. Application Data a continuation of application No. 15/231,078, filed on Aug. 8, 2016, now Pat. No. 10,279,823.

(58) Field of Classification Search
USPC ..... 701/20
See application file for complete search history.

(56) References Cited

U.S. PATENT DOCUMENTS 3,457,403 A * 7/1969 Smith, Jr. ..... B61L 3/008 246/187 B
3,519,805 A * 7/1970 Thorne-Booth ..... B66B 1/285 701/70
3,639,754 A * 2/1972 Kovalcik ..... B61L 3/002 246/182 B
3,655,962 A * 4/1972 Koch ..... B60T 7/128 246/182 C
3,727,046 A * 4/1973 Woods ..... B61L 3/008 246/182 C
3,790,778 A * 2/1974 Oster ..... B61L 3/008 246/182 C
3,790,779 A * 2/1974 Paddison ..... B61L 3/002 246/182 C
3,850,391 A * 11/1974 Marie ..... B61L 3/008 246/182 R
3,891,833 A * 6/1975 Rhoton ..... B61L 3/002 701/20
3,921,946 A * 11/1975 Norton ..... B61L 3/002 246/182 A
3,934,125 A * 1/1976 Macano ..... B61L 27/04 701/20
3,937,432 A * 2/1976 Birkin ..... B61L 3/125 246/187 B
3,974,992 A * 8/1976 Matty ..... B61L 3/008 246/182 B
4,000,872 A * 1/1977 Grundy ..... B60L 15/32 246/182 R
4,005,837 A * 2/1977 Grundy ..... B61L 3/008 246/182 B
4,005,838 A * 2/1977 Grundy ..... B60L 15/20 246/182 B
4,015,082 A * 3/1977 Matty ..... B61L 3/24 701/20
4,015,807 A * 4/1977 Bourree ..... B61L 3/008 246/187 B
4,041,283 A * 8/1977 Mosier ..... G09B 9/04 701/20
4,066,230 A * 1/1978 Nohmi ..... B60L 15/20 246/182 B
4,093,162 A * 6/1978 Takaoka ..... B61L 3/008 701/20
4,107,253 A * 8/1978 Borg ..... B61L 3/00 246/182 B
4,118,774 A * 10/1978 Franke ..... B60L 3/08 104/300
4,179,739 A * 12/1979 Virnot ..... G01P 7/00 246/182 R
4,181,943 A * 1/1980 Mercer, Sr. ..... B61L 3/002 246/182 B
4,190,220 A * 2/1980 Hahn ..... B60L 7/00 104/295
4,208,717 A * 6/1980 Rush ..... B61L 27/0038 701/20
4,209,828 A * 6/1980 Anderson ..... B61L 15/0063 701/20
4,217,643 A * 8/1980 Anderson ..... B61L 3/221 701/20
4,220,221 A * 9/1980 Gingrich ..... B60L 3/08 187/295
4,234,922 A * 11/1980 Wilde ..... B61C 17/12 701/20
4,235,402 A * 11/1980 Matty ..... B61L 3/221 246/182 B
4,235,403 A * 11/1980 Gillen ..... B61K 7/12 104/26.2
4,270,716 A * 6/1981 Anderson ..... B61L 3/221 246/182 B
4,279,395 A * 7/1981 Boggio ..... B60L 15/40 246/182 R
4,302,811 A * 11/1981 McElhenny ..... B61L 3/125 246/182 B
4,330,830 A * 5/1982 Perry ..... B61L 3/225 701/117
4,384,695 A * 5/1983 Nohmi ..... B61L 3/12 246/182 B
4,401,035 A * 8/1983 Spigarelli ..... B61C 17/12 105/61
4,410,154 A * 10/1983 Matty ..... B61L 3/008 246/182 B
4,459,668 A * 7/1984 Inoue ..... B61L 3/008 246/182 B
4,495,578 A * 1/1985 Sibley ..... B61L 3/008 701/20
4,556,941 A * 12/1985 Zuber ..... B61L 3/006 246/182 B
4,558,415 A * 12/1985 Zuber ..... B60K 31/0058 246/182 B
4,562,543 A * 12/1985 Zuber ..... B61L 3/008 246/182 B
4,566,067 A * 1/1986 Sahasrabudhe ..... B61L 3/221 701/117
4,578,754 A * 3/1986 Sahasrabudhe ..... B61L 3/008 246/182 B
4,602,335 A * 7/1986 Perlmutter ..... B60L 15/22 701/20
4,617,627 A * 10/1986 Yasunobu ..... B61L 3/008 701/20
4,618,930 A * 10/1986 Ueno ..... B61L 3/008 701/20
4,620,280 A * 10/1986 Conklin ..... B65G 35/063 104/166
4,625,279 A * 11/1986 Zuber ..... B61L 25/021 246/182 R
4,630,216 A * 12/1986 Tyler ..... B61L 27/0022 700/229
4,709,194 A * 11/1987 Yagi ..... B60T 8/1705 318/52
4,710,880 A * 12/1987 Zuber ..... B61L 25/021 246/182 C
4,721,045 A * 1/1988 Okawa ..... B60L 15/005 104/290
4,742,460 A * 5/1988 Hollands ..... B61L 13/04 701/19
4,835,693 A * 5/1989 Smith ..... B60T 13/662 246/182 B
4,847,770 A * 7/1989 Kane ..... B60T 13/665 701/20
4,852,007 A * 7/1989 Yasunobu ..... B61L 3/008 701/70
4,853,883 A * 8/1989 Nickles ..... G09B 9/04 703/8
4,919,057 A * 4/1990 Riley ..... B61L 3/18 104/295
4,924,395 A * 5/1990 Evans ..... B60T 8/1705 701/71
4,926,955 A * 5/1990 Ohmura ..... B62D 7/148 180/414
4,956,779 A * 9/1990 Rutherford ..... B60L 15/20 701/20

(56) References Cited

U.S. PATENT DOCUMENTS 4,994,969 A * 2/1991 Petit ..... B61L 17/00 246/182 AB
5,006,847 A * 4/1991 Rush ..... B61L 27/0022 246/122 R
5,006,989 A * 4/1991 Parker ..... B61L 3/246 246/182 C
5,036,468 A * 7/1991 Roselli ..... B60T 13/665 701/20
5,043,648 A * 8/1991 Strenzke ..... G05B 9/03 318/632
5,086,641 A * 2/1992 Roselli ..... G01D 18/008 250/231.18
5,109,343 A * 4/1992 Budway ..... B61L 3/008 701/20
5,117,163 A * 5/1992 Sandberg ..... B60L 3/10 318/52
5,136,516 A * 8/1992 Twombly ..... B61C 17/04 246/1 C
5,167,385 A * 12/1992 Hafner ..... B60G 17/019 244/195
5,181,679 A * 1/1993 Frielinghaus ..... B61L 3/008 246/182 R
5,239,472 A * 8/1993 Long ..... G07C 5/004 246/182 R
5,290,095 A * 3/1994 Wood ..... B60T 17/228 303/122.01
5,303,157 A * 4/1994 Root ..... B60T 13/665 246/182 R
5,315,520 A * 5/1994 Drake ..... B60L 3/12 246/182 B
5,340,062 A * 8/1994 Heggestad ..... B61L 3/008 246/167 R
5,364,047 A * 11/1994 Petit ..... B61L 3/008 246/122 R
5,366,039 A * 11/1994 Sawada ..... B60K 28/16 180/197
5,374,877 A * 12/1994 Imaseki ..... B60L 15/2045 318/34
5,416,707 A * 5/1995 Reng ..... B61C 15/14 701/70
5,436,631 A * 7/1995 Magori ..... B61L 3/008 246/182 C
5,440,489 A * 8/1995 Newman ..... B61L 3/006 340/994
5,449,049 A * 9/1995 Every ..... B60T 8/17636 180/197
5,459,663 A * 10/1995 Franke ..... B61L 3/246 246/122 R
5,475,818 A * 12/1995 Molyneaux ..... G06F 15/17 701/20
5,487,516 A * 1/1996 Murata ..... B61L 27/0022 246/182 C
5,500,799 A * 3/1996 Balukin ..... B60L 15/20 701/20
5,535,122 A * 7/1996 Wood ..... B60T 8/885 303/122
5,544,057 A * 8/1996 Matsuoka ..... B60L 15/20 701/20
5,570,284 A * 10/1996 Roselli ..... B60L 3/12 246/187 C
5,583,769 A * 12/1996 Saitoh ..... G06F 11/184 701/79
5,590,603 A * 1/1997 Lund ..... B61B 13/00 104/124
5,590,604 A * 1/1997 Lund ..... B61B 13/00 104/124
5,598,783 A * 2/1997 Lund ..... B61B 13/00 104/124
5,610,819 A * 3/1997 Mann ..... B60L 3/10 701/20
5,613,654 A * 3/1997 Gellermann ..... B61L 3/008 246/182 B
5,623,413 A * 4/1997 Matheson ..... B61L 27/0022 701/117
5,659,471 A * 8/1997 Parmee ..... B60R 25/06 307/10.2
5,659,734 A * 8/1997 Tsuruta ..... B61L 27/0022
5,681,015 A * 10/1997 Kull ..... B61L 15/0054 246/187 C
5,696,682 A * 12/1997 Benoliel ..... B61L 3/008 701/70
5,704,446 A * 1/1998 Chandy ..... B62D 5/0466 180/446
5,706,735 A * 1/1998 Lund ..... B61B 13/00 104/130.07
5,744,707 A * 4/1998 Kull ..... G01L 5/28 340/453
5,787,371 A * 7/1998 Balukin ..... B60L 15/32 246/187 A
5,805,797 A * 9/1998 Sato ..... B61L 3/008 714/48
5,828,979 A * 10/1998 Polivka ..... B61L 27/0016 701/117
5,836,529 A * 11/1998 Gibbs ..... B61L 27/0022 246/122 R
5,899,946 A * 5/1999 Iyoda ..... B60R 21/0133 701/20
5,953,995 A * 9/1999 Saillant ..... B61B 13/125 104/88.03
5,954,780 A * 9/1999 Jang ..... B61L 23/34 701/93
5,978,718 A * 11/1999 Kull ..... B61L 29/00 701/19
5,983,144 A * 11/1999 Bonissone ..... B60T 7/22 246/182 R
5,995,737 A * 11/1999 Bonissone ..... B60T 8/1705 303/135
5,995,881 A * 11/1999 Kull ..... B61L 3/008 701/20
5,999,863 A * 12/1999 Lin ..... A63H 19/24 188/124
6,012,011 A * 1/2000 Johnson ..... B60T 8/1705 701/82
6,029,103 A * 2/2000 Faubel ..... B61L 25/04 701/19
6,029,104 A * 2/2000 Kim ..... B61L 25/04 701/20
6,065,406 A * 5/2000 Katzer ..... A63H 19/24 105/1.4
6,067,496 A * 5/2000 Benoliel ..... B61L 3/006 701/93
6,108,596 A * 8/2000 Beike ..... B61F 5/22 104/164
6,112,142 A * 8/2000 Shockley ..... B61L 3/00 246/167 R
6,119,056 A * 9/2000 Beike ..... B61F 5/22 104/284
6,122,571 A * 9/2000 Gerstner ..... A63G 1/10 104/53
6,141,607 A * 10/2000 Hergert-Muckusch ..... B61L 27/0022 246/167 R
6,144,901 A * 11/2000 Nickles ..... B60T 17/228 701/19
6,148,269 A * 11/2000 Kumar ..... B60T 8/173 180/209
6,175,784 B1 * 1/2001 Jicha ..... B61L 3/125 188/107
6,230,086 B1 * 5/2001 Oguma ..... B61L 3/24 246/1 R
6,241,197 B1 * 6/2001 Harland ..... B61L 29/224 246/125
6,250,590 B1 * 6/2001 Hofestadt ..... B61L 27/0022 246/167 R
6,263,266 B1 * 7/2001 Hawthorne ..... G09B 9/048 701/19
6,314,345 B1 * 11/2001 Coombes ..... B61L 3/127 104/305

(56) References Cited

U.S. PATENT DOCUMENTS 6,314,358 B1 * 11/2001 Dorn ..... B60T 13/665 701/70
6,329,912 B1 * 12/2001 Takahashi ..... B60L 3/00 340/456
6,332,107 B1 * 12/2001 Gordon ..... B61L 3/006 246/182 A
6,353,780 B1 * 3/2002 Hart ..... B60T 7/126 701/20
6,374,165 B2 * 4/2002 Oguma ..... B61L 3/24 246/1 R
6,377,877 B1 * 4/2002 Doner ..... B61L 17/00 246/122 R
6,430,481 B1 * 8/2002 Lovelace, II ..... B61L 3/125 701/19
6,449,536 B1 * 9/2002 Brousseau ..... B61L 3/127 246/167 R
6,456,908 B1 * 9/2002 Kumar ..... B60L 3/0023 318/490
6,459,964 B1 * 10/2002 Vu ..... B61L 27/0016 701/19
6,459,965 B1 * 10/2002 Polivka ..... B61L 27/0038 180/168
6,463,367 B2 * 10/2002 Neff ..... B61B 13/04 246/3
6,466,847 B1 * 10/2002 Horst ..... B61C 17/12 246/187 A
6,480,766 B2 * 11/2002 Hawthorne ..... B61L 3/002 246/122 R
6,484,085 B2 * 11/2002 Marra ..... B60T 8/1705 246/182 B
6,496,770 B2 * 12/2002 Winner ..... B60W 30/16 701/96
6,505,103 B1 * 1/2003 Howell ..... B61C 17/12 340/933
6,516,253 B2 * 2/2003 Boggs ..... F02D 41/0097 701/20
6,532,405 B1 * 3/2003 Kumar ..... B60L 3/00 701/19
6,539,292 B1 * 3/2003 Ames, Jr. ..... A63H 19/10 105/1.4
6,539,293 B2 * 3/2003 Bachtiger ..... B61K 9/08 701/20
6,546,318 B2 * 4/2003 Barberis ..... B60T 13/665 105/4.3
6,580,976 B1 * 6/2003 Belcea ..... B60T 7/128 340/988
6,600,979 B1 * 7/2003 Kumar ..... B60T 8/172 180/197
6,658,330 B2 * 12/2003 Delaruelle ..... B61L 15/0027 455/418
6,658,331 B2 * 12/2003 Horst ..... B61C 17/12 246/187 A
6,665,609 B1 * 12/2003 Franke ..... B60W 40/04 701/99
6,675,077 B2 * 1/2004 Dembosky ..... B61F 5/383 701/19
6,725,134 B2 * 4/2004 Dillen ..... F02D 29/02 123/339.18
6,732,023 B2 * 5/2004 Sugita ..... B61L 27/0038 246/2 R
6,760,712 B1 * 7/2004 Bonissone ..... B61L 27/0055 701/19
6,763,291 B1 * 7/2004 Houpt ..... B60L 15/36 701/19
6,798,840 B1 * 9/2004 Kendig ..... H04L 1/22 340/901
6,799,096 B1 * 9/2004 Franke ..... B60L 15/2045 701/19
6,799,098 B2 * 9/2004 Horst ..... B61C 17/12 246/187 A
6,805,326 B1 * 10/2004 Baier ..... B61L 3/006 246/182 R
6,827,023 B2 * 12/2004 Katzer ..... A63H 19/24 105/1.4
6,830,224 B2 * 12/2004 Lewin ..... B61L 23/041 246/167 R
6,853,888 B2 * 2/2005 Kane ..... B61L 3/125 701/19
6,853,890 B1 * 2/2005 Horst ..... B61C 17/12 246/187 A
6,873,888 B2 * 3/2005 Kumar ..... B60L 15/20 701/19
6,873,962 B1 * 3/2005 Doner ..... B61L 27/0016 705/7.22
6,922,619 B2 * 7/2005 Baig ..... B60L 15/32 303/16
6,928,342 B2 * 8/2005 Horst ..... B61L 3/127 246/167 R
6,937,925 B2 * 8/2005 Smith ..... B60L 15/36 303/16
6,947,815 B2 * 9/2005 Young ..... A63H 19/24 246/1 R
6,950,732 B2 * 9/2005 Lumbis ..... B60T 13/665 701/20
6,957,131 B2 * 10/2005 Kane ..... B61L 3/12 701/19
6,975,927 B2 * 12/2005 Szklar ..... B61L 3/125 246/167 R
6,980,894 B1 * 12/2005 Gordon ..... B60L 3/0015 104/299
6,996,461 B2 * 2/2006 Kane ..... B61L 3/125 701/19
7,006,012 B2 * 2/2006 Taoka ..... B60L 3/0015 246/122 R
7,027,897 B2 * 4/2006 Shen ..... G05D 19/02 104/165
7,069,122 B1 * 6/2006 Higgs ..... B61L 3/127 246/167 R
7,069,123 B2 * 6/2006 Lapointe ..... B61L 15/0027 246/108
7,089,093 B2 * 8/2006 Lacote ..... B61L 23/34 701/19
7,096,096 B2 * 8/2006 Kane ..... B61L 15/0027 246/122 R
7,099,754 B2 * 8/2006 Sugita ..... B61L 23/14 246/14
7,117,137 B1 * 10/2006 Belcea ..... B61L 3/008 703/8
7,120,428 B2 * 10/2006 Higgs ..... B61L 3/127 455/418
7,174,285 B1 * 2/2007 Garney ..... H04L 65/80 370/228
7,176,645 B2 * 2/2007 Shimada ..... B60L 9/22 318/432
7,177,732 B2 * 2/2007 Kraeling ..... B61L 15/0081 303/22.6
7,302,319 B2 * 11/2007 Wu ..... B61L 27/04 104/27
7,315,770 B2 * 1/2008 Wade ..... B61L 29/00 246/1 R
7,328,090 B2 * 2/2008 Paehl ..... B61L 27/02 701/19
7,340,329 B2 * 3/2008 Marra ..... B60M 7/00 701/19
7,349,759 B2 * 3/2008 Peless ..... G05D 1/0219 318/250
7,353,093 B2 * 4/2008 Bamfield ..... B61L 29/24 246/111
7,356,474 B2 * 4/2008 Kumhyr ..... G10L 15/22 701/20
7,359,771 B2 * 4/2008 Soulie ..... H04W 36/32 701/19
7,386,391 B2 * 6/2008 Morariu ..... B61L 27/0027 701/117
7,395,141 B1 * 7/2008 Seek ..... B61C 17/12 246/182 R
7,398,140 B2 * 7/2008 Kernwein ..... B61L 23/00 246/115

(56) References Cited

U.S. PATENT DOCUMENTS 7,400,952 B2 * 7/2008 Pervaiz ..... B01D 53/261 701/19
7,426,917 B1 * 9/2008 Gallagher ..... F02D 41/403 123/299
7,469,758 B2 * 12/2008 Iwanaka ..... B60W 20/15 180/65.1
7,520,472 B2 * 4/2009 Peltz ..... B61L 3/127 246/182 B
7,533,943 B2 * 5/2009 Kahrs ..... B60L 7/26 303/20
7,561,254 B2 * 7/2009 Koide ..... B65G 1/0421 356/28
7,577,502 B1 * 8/2009 Henry ..... B61L 5/102 246/218
7,593,795 B2 * 9/2009 Kane ..... B61K 9/12 701/19
7,647,141 B2 * 1/2010 Foster ..... B61L 27/0094 701/19
7,664,459 B2 * 2/2010 Smith, Jr. ..... H04B 7/0802 455/7
7,679,298 B2 * 3/2010 Kumar ..... B60L 15/20 318/66
7,684,905 B2 * 3/2010 Franckart ..... B61L 1/14 701/19
7,693,623 B2 * 4/2010 Fox ..... G06Q 50/28 701/19
7,706,934 B2 * 4/2010 Sakamoto ..... G01C 21/20 701/19
7,711,458 B2 * 5/2010 Katzer ..... A63H 19/24 701/19
7,725,252 B2 * 5/2010 Heddebaut ..... B61L 27/0038 701/408
7,756,613 B2 * 7/2010 Katsuta ..... B61L 11/08 701/19
7,822,515 B2 * 10/2010 George ..... H02G 1/10 701/20
7,835,830 B2 * 11/2010 Ellmann ..... B60L 13/06 701/19
7,840,338 B2 * 11/2010 Paolacci ..... B61L 27/0038 701/117
7,890,223 B1 * 2/2011 Young ..... B61L 1/16 701/19
7,917,345 B2 * 3/2011 Hawthorne ..... G09B 9/04 703/8
7,983,805 B2 * 7/2011 Bryant ..... B61C 17/12 701/19
8,082,071 B2 * 12/2011 Daum ..... B61L 27/0033 701/19
8,090,486 B2 * 1/2012 Meyer ..... B61L 3/12 701/20
8,112,189 B2 * 2/2012 Peltz ..... B61L 3/127 701/19
8,150,568 B1 * 4/2012 Gray ..... B61L 29/00 701/19
8,224,237 B2 * 7/2012 Smith, Jr. ..... B61L 15/0027 455/7
8,229,350 B2 * 7/2012 Smith, Jr. ..... H04B 7/2606 455/7
8,239,080 B2 * 8/2012 Chun ..... B61L 27/0027 701/19
8,264,330 B2 * 9/2012 Yeldell ..... B61L 27/0088 340/10.1
8,271,153 B2 * 9/2012 Kumar ..... B61L 25/025 701/19
8,280,566 B2 * 10/2012 Foy, III ..... B60L 15/00 701/19
8,328,143 B2 * 12/2012 Groves, Jr. ..... B61L 27/0061 246/3
8,406,940 B2 * 3/2013 Otsubo ..... G09B 29/007 701/19
8,467,920 B2 * 6/2013 Asuka ..... B61L 23/14 701/19
8,478,463 B2 * 7/2013 Knott ..... B61L 3/221 701/20
8,483,894 B2 * 7/2013 Marra ..... B60T 13/665 701/19
8,483,895 B1 * 7/2013 Beregi ..... B61L 3/24 701/20
8,509,970 B2 * 8/2013 Kane ..... B61L 25/025 701/20
8,509,971 B1 * 8/2013 Isailovski ..... B60T 13/665 701/20
8,510,026 B2 * 8/2013 Desanzo ..... G06F 16/211 701/120
8,515,602 B2 * 8/2013 Jakobs ..... F02D 41/22 701/20
8,515,697 B2 * 8/2013 Alexander ..... B61L 5/1881 702/58
8,521,345 B2 8/2013 Cooper et al.
8,522,690 B2 * 9/2013 Smith ..... B61L 25/023 105/26.05
8,538,611 B2 * 9/2013 Kumar ..... B61L 27/0027 701/20
8,548,654 B2 * 10/2013 Katsuta ..... B61L 27/0038 701/19
8,554,397 B1 * 10/2013 Nishinaga ..... G08G 1/20 701/19
8,560,151 B2 * 10/2013 Armitage ..... B61K 13/00 701/20
8,600,591 B2 * 12/2013 Weber ..... B61C 17/12 701/20
8,606,456 B2 * 12/2013 Nordberg ..... B60K 17/356 701/29.3
8,626,435 B2 * 1/2014 Gardea ..... G01S 19/37 701/408
8,655,516 B2 2/2014 Noffsinger et al.
8,670,954 B2 * 3/2014 Yoon ..... G01G 19/047 702/174
8,676,410 B2 * 3/2014 Houpt ..... B61L 27/0027 701/19
8,700,237 B1 * 4/2014 Przybylski ..... B61C 17/12 701/19
8,706,328 B1 * 4/2014 Nishinaga ..... B61L 5/00 701/19
8,712,611 B2 * 4/2014 Denis ..... B61L 15/0072 701/19
8,714,494 B2 * 5/2014 Weber ..... B61L 15/0063 246/131
8,725,325 B1 * 5/2014 Nishinaga ..... B61L 15/0063 701/20
8,738,202 B2 * 5/2014 Liberatore ..... B61C 15/08 701/19
8,744,652 B1 * 6/2014 Nishinaga ..... B60T 8/1705 701/20
8,751,060 B2 * 6/2014 Kinoshita ..... G05D 1/0289 701/2
8,751,072 B1 * 6/2014 Goldman ..... B61L 1/162 701/19
8,751,074 B2 * 6/2014 Porma ..... B66C 13/30 701/20
8,774,990 B2 * 7/2014 Burg ..... B61L 15/0063 701/19
8,805,605 B2 * 8/2014 Cooper ..... B61L 27/0027 701/93
8,831,801 B1 * 9/2014 Raghunathan ..... G06F 17/11 701/19
8,855,975 B2 * 10/2014 Duan ..... G01B 21/10 703/2
8,874,345 B2 * 10/2014 Nandedkar ..... G06F 17/00 701/70
8,903,575 B2 * 12/2014 Mischler ..... F02D 41/1454 701/20
8,924,048 B2 * 12/2014 Smith ..... B60T 7/16 701/19
8,924,050 B2 * 12/2014 Katsuta ..... B61L 27/0061 701/19
8,942,869 B2 * 1/2015 Woo ..... B61L 17/00 701/20

(56) References Cited

U.S. PATENT DOCUMENTS 8,965,619 B2 * 2/2015 Sullivan ..... G05D 1/0088 701/23
8,996,208 B2 * 3/2015 Shoppa ..... B61L 27/0088 701/19
8,996,243 B2 * 3/2015 Skibbe ..... B61K 7/00 701/34.4
9,002,549 B2 * 4/2015 Obradovich ..... B60R 25/042 701/20
9,043,044 B2 * 5/2015 Otsubo ..... B61L 15/0072 701/1
9,228,321 B1 * 1/2016 Stratton ..... G05D 1/0022
9,229,448 B1 * 1/2016 Luther ..... B61L 27/0027
9,308,902 B1 4/2016 Noffsinger
9,387,866 B1 * 7/2016 Cairano ..... B60T 13/665
9,592,842 B1 * 3/2017 Mercer ..... B61L 3/02
9,731,735 B1 * 8/2017 Nishinaga ..... B61L 3/008
9,910,433 B1 * 3/2018 Golden ..... B61L 23/00
2001/0037174 A1 11/2001 Dickerson
2001/0051846 A1 * 12/2001 Nievergelt ..... B61L 3/008 701/52
2002/0032587 A1 * 3/2002 Bermel ..... G06Q 10/02 705/5
2002/0128757 A1 * 9/2002 Chirescu ..... B61L 27/0022 701/19
2003/0034423 A1 * 2/2003 Hess, Jr. ..... B61L 25/025 246/167 R
2003/0093195 A1 * 5/2003 Ishikawa ..... B61L 3/125 701/19
2003/0213875 A1 * 11/2003 Hess, Jr. ..... B61L 25/021 246/167 R
2004/0006413 A1 * 1/2004 Kane ..... B61L 25/025 701/19
2004/0010432 A1 * 1/2004 Matheson ..... G06Q 10/06312 705/7.22
2004/0015275 A1 * 1/2004 Herzog ..... B61L 25/021 701/19
2004/0015276 A1 * 1/2004 Kane ..... B61L 25/021 701/19
2004/0034556 A1 * 2/2004 Matheson ..... G06Q 10/047 705/7.24
2004/0064235 A1 * 4/2004 Cole ..... G05B 13/048 701/70
2004/0122569 A1 * 6/2004 Bidaud ..... B61K 9/08 701/19
2004/0143374 A1 * 7/2004 Horst ..... B61L 17/00 701/19
2004/0172175 A1 * 9/2004 Julich ..... B61L 27/0027 701/19
2004/0181321 A1 * 9/2004 Fries ..... B61L 29/226 701/19
2005/0065674 A1 * 3/2005 Houpt ..... B61L 3/002 701/19
2005/0065677 A1 * 3/2005 Leblanc ..... G01L 5/284 701/33.7
2005/0109882 A1 * 5/2005 Armbruster ..... B61L 15/0081 246/167 R
2005/0137761 A1 * 6/2005 Lungu ..... B61L 25/021 701/20
2005/0192720 A1 * 9/2005 Christie ..... B61L 27/0022 701/19
2005/0216143 A1 * 9/2005 Tolmei ..... B61L 3/221 701/20
2006/0020375 A1 * 1/2006 Harrison ..... B61L 27/0088 701/20
2006/0100753 A1 * 5/2006 Katzer ..... A63H 19/24 701/20
2006/0129289 A1 * 6/2006 Kumar ..... B60L 15/2045 105/26.05
2006/0138285 A1 * 6/2006 Oleski ..... B61L 15/0027 246/167 R
2006/0200437 A1 * 9/2006 Howlett ..... B61L 3/006 706/45
2006/0212185 A1 * 9/2006 Philp ..... G06Q 10/08 701/19
2006/0212186 A1 * 9/2006 Philp ..... G06Q 10/047 701/19
2006/0212187 A1 * 9/2006 Wills ..... G06Q 10/06 701/19
2006/0212190 A1 * 9/2006 Philp ..... B61L 27/0016 701/19
2006/0282199 A1 * 12/2006 Daum ..... B61L 3/006 701/19
2007/0061056 A1 * 3/2007 Valsorda ..... H04L 67/12 701/20
2007/0137514 A1 * 6/2007 Kumar ..... F02D 41/021 105/26.05
2007/0142984 A1 * 6/2007 Plawecki ..... B61L 3/008 701/20
2007/0173990 A1 * 7/2007 Smith ..... B61C 15/14 701/20
2007/0219680 A1 * 9/2007 Kumar ..... B61L 3/006 701/19
2007/0219681 A1 * 9/2007 Kumar ..... B61L 27/0027 701/19
2007/0219682 A1 * 9/2007 Kumar ..... B61L 27/0027 701/19
2007/0219683 A1 * 9/2007 Daum ..... B61C 1/00 701/19
2007/0225878 A1 * 9/2007 Kumar ..... B61L 3/006 701/19
2007/0233364 A1 * 10/2007 Kumar ..... B61L 15/009 701/123
2007/0250220 A1 * 10/2007 Hunt ..... H04B 1/082 701/1
2007/0250225 A1 * 10/2007 Nickles ..... B61L 3/008 701/20
2008/0000381 A1 * 1/2008 Bartley ..... B60T 13/662 105/49
2008/0015745 A1 * 1/2008 Gaegauf ..... B61B 3/02 701/19
2008/0033605 A1 * 2/2008 Daum ..... B61L 3/006 701/19
2008/0051969 A1 * 2/2008 Demaya ..... B61L 27/04 701/79
2008/0077285 A1 * 3/2008 Kumar ..... B61L 3/127 701/19
2008/0125924 A1 * 5/2008 Daum ..... B61L 3/006 701/19
2008/0128562 A1 * 6/2008 Kumar ..... B61L 15/0081 246/186
2008/0148993 A1 * 6/2008 Mack ..... B60L 9/00 105/35
2008/0154450 A1 * 6/2008 Sinnamon ..... F02D 41/009 701/20
2008/0154451 A1 * 6/2008 Dibble ..... G05D 13/62 701/20
2008/0154452 A1 * 6/2008 Kapp ..... B61L 27/0027 701/20
2008/0161984 A1 * 7/2008 Hrdlicka ..... B61L 3/006 701/20
2008/0167766 A1 * 7/2008 Thiyagarajan ..... B61L 3/006 701/19
2008/0167767 A1 * 7/2008 Brooks ..... B61L 3/006 701/20
2008/0183345 A1 * 7/2008 Chandra ..... B61L 3/006 701/19
2008/0183490 A1 * 7/2008 Martin ..... B61L 3/006 705/1.1
2008/0189000 A1 * 8/2008 Duong ..... B60T 7/22 701/20
2008/0195269 A1 * 8/2008 Lacy ..... B61L 3/006 701/24
2008/0201019 A1 * 8/2008 Kumar ..... B61L 3/006 700/286
2008/0201028 A1 * 8/2008 Brooks ..... B61L 3/006 701/20
2008/0202376 A1 * 8/2008 Meltser ..... F02D 41/0205 105/26.05

(56) References Cited

U.S. PATENT DOCUMENTS

2008/0208401 A1* 8/2008 Kumar ..... B61L 3/006 701/19
2008/0269967 A1* 10/2008 Kumar ..... B61L 3/006 701/20
2008/0281477 A1* 11/2008 Hawthorne ..... B61L 15/0054 701/19
2008/0288131 A1* 11/2008 Root ..... B60T 7/16 701/20
2008/0312775 A1* 12/2008 Kumar ..... B61L 3/006 701/2
2009/0069961 A1* 3/2009 Deepak ..... B60T 13/58 701/20
2009/0072096 A1* 3/2009 Ottow ..... B61L 17/00 246/182 BH
2009/0076667 A1* 3/2009 Otsubo ..... B61L 3/006 701/2
2009/0090818 A1* 4/2009 Kumar ..... B61C 15/00 246/186
2009/0099715 A1* 4/2009 Cho ..... B61L 27/04 701/20
2009/0099825 A1* 4/2009 Bollapragada ..... B61L 27/0055 703/8
2009/0118970 A1* 5/2009 Daum ..... B61L 3/006 701/102
2009/0119006 A1* 5/2009 Silver ..... B61L 25/025 701/465
2009/0125170 A1* 5/2009 Noffsinger ..... B60L 7/16 701/20
2009/0132113 A1* 5/2009 Kumar ..... B61L 3/006 701/33.4
2009/0187291 A1* 7/2009 Daum ..... B61L 3/006 701/2
2009/0198391 A1 8/2009 Kumar et al.
2009/0210106 A1* 8/2009 Carter ..... B60T 17/043 701/20
2009/0216395 A1* 8/2009 Kernwein ..... B61L 25/025 701/20
2009/0234522 A1* 9/2009 Desanzo ..... B61L 23/04 701/20
2009/0234523 A1* 9/2009 Nandedkar ..... B61L 25/021 701/20
2009/0254232 A1* 10/2009 Reichensperger ..... B66F 9/24 701/20
2009/0254233 A1* 10/2009 Noffsinger ..... B61L 27/0027 701/20
2009/0254239 A1* 10/2009 Daum ..... B61L 15/0081 701/31.4
2009/0255329 A1* 10/2009 Connell ..... B61L 15/0072 73/121
2009/0266943 A1* 10/2009 Kumar ..... B61L 3/006 246/28 R
2009/0271052 A1* 10/2009 Kumar ..... B61L 15/0072 701/19
2009/0276108 A1* 11/2009 Kumar ..... B61L 23/00 701/20
2009/0299555 A1* 12/2009 Houpt ..... B61L 27/0027 701/19
2009/0299623 A1* 12/2009 Weiler ..... B61L 25/025 701/529
2009/0312890 A1* 12/2009 Evans ..... B61L 17/00 701/2
2009/0326747 A1* 12/2009 Klein ..... B60T 17/228 701/20
2010/0019103 A1* 1/2010 Kane ..... B61C 17/12 246/186
2010/0023190 A1* 1/2010 Kumar ..... G05B 13/021 701/20
2010/0023191 A1* 1/2010 Stefani ..... G08G 5/06 701/21
2010/0043667 A1* 2/2010 Loser ..... B60L 3/00 104/284
2010/0049384 A1* 2/2010 Kraeling ..... B61L 15/0027 701/20
2010/0094483 A1* 4/2010 Denen ..... A63H 19/10 701/2
2010/0094489 A1* 4/2010 Moffitt ..... B61C 17/12 701/20
2010/0114404 A1* 5/2010 Donnelly ..... B61L 27/04 701/2
2010/0114407 A1* 5/2010 Klooster ..... G05D 1/0005 701/3
2010/0131130 A1* 5/2010 Kalyanam ..... B61L 25/021 701/20
2010/0139519 A1* 6/2010 Murillo ..... B61B 13/06 104/119
2010/0152934 A1* 6/2010 Root ..... B60T 17/228 701/20
2010/0153419 A1* 6/2010 Daum ..... G06F 16/27 707/758
2010/0168940 A1* 7/2010 King ..... B61C 15/12 701/20
2010/0168941 A1* 7/2010 Geiger ..... H04B 7/2606 701/20
2010/0168942 A1* 7/2010 Noffsinger ..... B63B 49/00 701/21
2010/0174427 A1* 7/2010 Sivasubramaniam .. B61L 3/006 701/19
2010/0211238 A1* 8/2010 David, Jr. ..... E01B 25/00 701/20
2010/0217462 A1* 8/2010 Shaffer ..... B61L 15/0072 701/19
2010/0235022 A1* 9/2010 Siddappa ..... B61L 3/006 701/20
2010/0241296 A1* 9/2010 Rhea, Jr. ..... B61L 27/04 701/20
2010/0256843 A1* 10/2010 Bergstein ..... B61L 15/0063 701/19
2010/0256852 A1* 10/2010 Mudalige ..... G08G 1/22 701/24
2010/0262321 A1* 10/2010 Daum ..... B61L 15/0081 701/20
2010/0280683 A1* 11/2010 Miyauchi ..... B61L 27/0038 701/20
2010/0299007 A1* 11/2010 Ghaly ..... B61L 3/221 701/20
2010/0305788 A1* 12/2010 Walter ..... B60T 17/20 701/20
2010/0318247 A1* 12/2010 Kumar ..... B61L 3/006 701/20
2010/0319565 A1* 12/2010 Mobasher ..... H02S 20/21 104/89
2010/0324761 A1* 12/2010 Nakazawa ..... B61C 15/00 701/20
2010/0332058 A1* 12/2010 Kane ..... B61L 25/025 701/20
2011/0029167 A1* 2/2011 Itano ..... B60T 13/665 701/20
2011/0035083 A1* 2/2011 Groves ..... B61L 27/0038 701/19
2011/0046827 A1* 2/2011 Yoon ..... B61L 27/04 701/20
2011/0060486 A1* 3/2011 Meltser ..... B61L 3/006 701/19
2011/0093144 A1* 4/2011 Goodermuth ..... B60T 13/665 701/20
2011/0118914 A1* 5/2011 Brooks ..... B61L 27/0027 701/20
2011/0125350 A1* 5/2011 Won ..... B61L 15/0072 701/20
2011/0160943 A1* 6/2011 Yoshikawa ..... G05B 11/42 701/20
2011/0178659 A1* 7/2011 Lehmann ..... B61L 3/006 701/19
2011/0184619 A1* 7/2011 Kamata ..... B61L 3/121 701/70
2011/0184621 A1* 7/2011 Bock ..... G01S 13/825 701/70

(56) References Cited

U.S. PATENT DOCUMENTS

2011/0215948 A1* 9/2011 Borgerson ..... G06Q 10/0831 340/989
2011/0257869 A1* 10/2011 Kumar ..... B61L 25/025 701/103
2011/0270475 A1* 11/2011 Brand ..... B61L 15/0027 701/20
2011/0315042 A1* 12/2011 Lehmann ..... B61L 3/006 105/26.05
2012/0001029 A1* 1/2012 Kondo ..... B61L 15/0027 246/108
2012/0029740 A1* 2/2012 Bock ..... B61L 3/125 701/20
2012/0035791 A1* 2/2012 Bottlang ..... B61C 9/14 701/20
2012/0065818 A1* 3/2012 Haaf ..... B61L 3/006 701/20
2012/0072088 A1* 3/2012 Cutright ..... B60T 17/228 701/70
2012/0116617 A1* 5/2012 Schaffler ..... B61C 15/08 701/20
2012/0116642 A1* 5/2012 Mitake ..... B61L 27/0027 701/93
2012/0126065 A1* 5/2012 Smith ..... B61L 15/0027 246/167 R
2012/0130568 A1* 5/2012 Golden ..... B61L 27/0077 701/20
2012/0136515 A1* 5/2012 Noffsinger ..... B61L 15/0027 701/19
2012/0138752 A1* 6/2012 Carlson ..... B61L 3/02 246/126
2012/0166025 A1* 6/2012 Tokumaru ..... B61L 27/04 701/20
2012/0173055 A1* 7/2012 Yamamoto ..... B61L 25/026 701/20
2012/0173056 A1* 7/2012 Kumar ..... B61C 17/12 701/20
2012/0193110 A1* 8/2012 Bouthors ..... B61L 25/025 169/46
2012/0197466 A1* 8/2012 Yoshimoto ..... B61L 27/04 701/20
2012/0221181 A1* 8/2012 Rosener ..... A63H 19/24 701/20
2012/0232726 A1* 9/2012 Nandedkar ..... B61L 3/008 701/19
2012/0245766 A1* 9/2012 Cooper ..... B61L 3/006 701/2
2012/0245770 A1* 9/2012 Yamamoto ..... B61L 27/0038 701/20
2012/0259487 A1* 10/2012 Friesen ..... B61F 5/245 701/20
2012/0259531 A1* 10/2012 Daum ..... B61L 3/006 701/102
2012/0265379 A1* 10/2012 Chen ..... B61L 15/0036 701/20
2012/0277940 A1* 11/2012 Kumar ..... B61L 27/0027 701/20
2012/0290156 A1* 11/2012 Woo ..... B61L 3/006 701/19
2012/0290185 A1 11/2012 Cooper et al.
2012/0296545 A1* 11/2012 Cooper ..... B61L 15/0036 701/99
2012/0303237 A1* 11/2012 Kumar ..... B61D 17/12 701/93
2012/0323957 A1* 12/2012 Rout ..... B61L 15/0072 707/769
2013/0006443 A1* 1/2013 Woo ..... B61L 15/0027 701/2
2013/0006451 A1* 1/2013 Cooper ..... B60L 7/12 701/19
2013/0006452 A1* 1/2013 Takagi ..... B60L 9/00 701/20
2013/0018531 A1* 1/2013 Kumar ..... B61L 25/025 701/2
2013/0018536 A1* 1/2013 Cooper ..... B61L 3/008 701/20
2013/0035811 A1* 2/2013 Schroeck ..... B61L 15/0036 701/19
2013/0048795 A1* 2/2013 Cross ..... B61L 25/025 246/122 R
2013/0066490 A1* 3/2013 Liberatore ..... B61L 3/127 701/20
2013/0066491 A1* 3/2013 McCrary ..... B60C 7/00 701/20
2013/0096741 A1* 4/2013 Jung ..... B61L 3/006 701/20
2013/0116865 A1* 5/2013 Cooper ..... B61L 17/00 701/20
2013/0131909 A1* 5/2013 Cooper ..... B61L 27/0016 701/23
2013/0138276 A1* 5/2013 Soderi ..... B61L 3/008 701/19
2013/0138278 A1* 5/2013 Fujiwara ..... B61H 11/10 701/20
2013/0144467 A1* 6/2013 Kickbusch ..... G08G 7/00 701/2
2013/0144517 A1* 6/2013 Kickbusch ..... B61L 3/006 701/119
2013/0151041 A1* 6/2013 Otsubo ..... B61L 15/0081 701/20
2013/0166114 A1* 6/2013 Baines ..... B61L 23/06 701/20
2013/0168504 A1* 7/2013 Thiemann ..... B61L 25/02 246/2 R
2013/0171590 A1* 7/2013 Kumar ..... B61C 17/12 434/62
2013/0173083 A1* 7/2013 Cooper ..... B61L 27/0027 701/1
2013/0200222 A1* 8/2013 Cooper ..... B61C 17/12 246/187 C
2013/0238176 A1* 9/2013 Watanabe ..... B60L 3/106 701/20
2013/0268147 A1* 10/2013 Chundru ..... B61C 17/12 701/19
2013/0311014 A1* 11/2013 Matusiak ..... B61C 17/12 701/20
2013/0317676 A1* 11/2013 Cooper ..... G01N 29/265 701/20
2013/0325223 A1* 12/2013 Sengupta ..... B61L 27/0027 701/19
2013/0325224 A1* 12/2013 Yamamoto ..... B61L 3/006 701/20
2013/0332012 A1* 12/2013 Haas ..... B61H 13/30 701/20
2013/0338860 A1* 12/2013 Herden ..... B61H 9/00 701/20
2013/0338901 A1* 12/2013 Kumar ..... F02D 41/021 701/102
2014/0005876 A1* 1/2014 Xu ..... B61L 3/006 701/29.1
2014/0005877 A1* 1/2014 Xu ..... G06Q 10/04 701/29.1
2014/0012454 A1* 1/2014 Fournier ..... G06Q 10/04 701/23
2014/0032023 A1* 1/2014 Kumar ..... B60T 7/12 701/20
2014/0046513 A1* 2/2014 Cooper ..... B61L 23/044 701/20
2014/0046514 A1* 2/2014 Jennek ..... B60T 7/085 701/20
2014/0054424 A1* 2/2014 Xu ..... B61L 25/026 246/122 R
2014/0067246 A1* 3/2014 Eldredge ..... B61L 27/0022 701/123
2014/0081488 A1* 3/2014 Erhard ..... B61L 27/0027 701/20
2014/0088802 A1* 3/2014 Knollmann ..... B61L 15/0072 701/20

(56) References Cited

U.S. PATENT DOCUMENTS

2014/0094998 A1* 4/2014 Cooper ..... B61L 3/006 701/2
2014/0095113 A1* 4/2014 Cao ..... B61L 3/008 702/184
2014/0107876 A1* 4/2014 Kapp ..... B61L 3/006 701/20
2014/0114507 A1* 4/2014 Kernwein ..... B60L 3/04 701/19
2014/0114508 A1* 4/2014 Przybylski ..... B61L 15/0027 701/20
2014/0117167 A1* 5/2014 Donnelly, III ..... B61L 15/0036 246/187 A
2014/0131524 A1* 5/2014 Grimm ..... B61L 15/0072 246/3
2014/0136025 A1* 5/2014 Cooper ..... G08G 9/00 701/2
2014/0163785 A1* 6/2014 Kawada ..... B61C 17/12 701/20
2014/0172205 A1* 6/2014 Ruhland ..... B61L 15/0063 701/19
2014/0180499 A1* 6/2014 Cooper ..... B61L 27/0005 701/2
2014/0180510 A1* 6/2014 Fournier ..... G08G 9/00 701/20
2014/0183304 A1* 7/2014 Er ..... B61L 15/0081 246/169 R
2014/0188306 A1* 7/2014 Kumar ..... B61C 17/12 701/2
2014/0188375 A1* 7/2014 Kumar ..... B61L 27/0027 701/117
2014/0200741 A1* 7/2014 Er ..... B61L 7/06 701/2
2014/0207316 A1* 7/2014 Kolambekar ..... B61C 17/12 701/19
2014/0209752 A1* 7/2014 Myokei ..... B61L 25/026 246/27
2014/0209759 A1* 7/2014 Tsukamoto ..... B61L 3/008 246/2 S
2014/0209760 A1* 7/2014 Tsukamoto ..... B61L 23/34 246/2 S
2014/0214248 A1* 7/2014 Yamada ..... B61L 3/008 701/20
2014/0222259 A1* 8/2014 Yoshimoto ..... B61L 27/0027 701/20
2014/0229041 A1* 8/2014 Egler ..... B61L 15/00 701/19
2014/0277861 A1* 9/2014 Raghunathan ..... G06Q 10/06 701/19
2014/0277862 A1* 9/2014 Pritchard ..... B61L 15/0081 701/19
2014/0309822 A1* 10/2014 Beutler ..... B61L 23/005 701/20
2014/0350756 A1* 11/2014 Schoonmaker ..... G01G 19/08 701/19
2014/0350767 A1* 11/2014 Fries ..... B61L 15/0027 701/23
2014/0358337 A1* 12/2014 Ikejima ..... B61L 25/02 701/19
2014/0358339 A1* 12/2014 Cooper ..... B61L 3/006 701/20
2014/0361125 A1* 12/2014 Fries ..... B61L 29/04 246/473.1
2014/0365047 A1* 12/2014 Porsch ..... B60L 9/00 701/19
2014/0365049 A1* 12/2014 Cook ..... B61C 5/00 701/20
2014/0371959 A1* 12/2014 Kumar ..... B60T 13/665 701/20
2015/0005988 A1* 1/2015 Cox ..... B60L 15/20 701/3
2015/0014488 A1* 1/2015 Saito ..... B60L 3/0015 246/184
2015/0051761 A1* 2/2015 Er ..... B61L 3/121 701/20
2015/0057853 A1* 2/2015 Fisher ..... B61C 17/12 701/20
2015/0073692 A1 3/2015 Malikopoulos
2015/0088344 A1* 3/2015 Shakal ..... B61L 15/0036 701/20
2015/0088345 A1* 3/2015 Nandedkar ..... B61L 25/021 701/20
2015/0102176 A1* 4/2015 Tippey ..... B61L 3/125 246/3
2015/0102177 A1* 4/2015 Tippey ..... B61L 27/0027 246/122 R
2015/0120101 A1* 4/2015 Kimura ..... B61L 27/0027 701/20
2015/0134147 A1* 5/2015 Woo ..... B61L 27/0077 701/2
2015/0134157 A1* 5/2015 Aurich ..... B60T 17/228 701/20
2015/0158512 A1* 6/2015 Shaffer ..... B61L 15/0072 701/1
2015/0165930 A1* 6/2015 Sawa ..... B60L 7/14 701/19
2015/0168158 A1* 6/2015 Mathews, Jr. ..... B60L 15/2009 701/400
2015/0175180 A1* 6/2015 Szprynger ..... B61L 3/008 701/2
2015/0177012 A1* 6/2015 Cooper ..... B61L 3/006 701/416
2015/0191090 A1* 7/2015 Sawa ..... B61D 27/0018 701/19
2015/0210295 A1* 7/2015 Meltser ..... B61C 17/12 701/20
2015/0210302 A1* 7/2015 Kraeling ..... B61L 15/0036 701/117
2015/0232097 A1* 8/2015 Luther ..... B61L 3/006 701/123
2015/0251640 A1* 9/2015 Batz ..... B60T 8/172 701/20
2015/0251676 A1* 9/2015 Golden ..... B61L 27/0038 701/19
2015/0274184 A1* 10/2015 Golden ..... B61L 17/00 701/19
2015/0291188 A1* 10/2015 Morton ..... B61L 3/121 701/20
2015/0291193 A1* 10/2015 Perras ..... B61L 15/0018 246/122 R
2015/0308927 A1* 10/2015 Kono ..... B61L 23/042 702/182
2015/0329128 A1* 11/2015 Porsch ..... B61L 27/04 701/19
2015/0338848 A1* 11/2015 Kumar ..... B61L 23/00 701/70
2015/0344008 A1* 12/2015 Beutler ..... B60T 13/665 701/20
2016/0001800 A1* 1/2016 Fritzsch ..... G01P 1/07 246/191
2016/0010574 A1* 1/2016 Kumar ..... B61L 3/006 701/104
2016/0031459 A1* 2/2016 Murren ..... B61L 15/0027 701/22
2016/0039439 A1* 2/2016 Fahmy ..... B61L 27/0038 701/20
2016/0039440 A1* 2/2016 Voelz ..... B61L 27/04 701/20
2016/0046301 A1* 2/2016 Wiesand ..... B61H 13/00 701/20
2016/0046306 A1* 2/2016 Miyajima ..... B61L 27/0005 701/19
2016/0046308 A1* 2/2016 Chung ..... B61L 25/021 701/20
2016/0068172 A1* 3/2016 Hourtane ..... B61L 3/008 701/19
2016/0068173 A1* 3/2016 Fuchs ..... B61L 15/0027 340/994

(56) References Cited

U.S. PATENT DOCUMENTS

2016/0075354 A1* 3/2016 Jung ..... B61L 15/0072 246/182 R
2016/0075357 A1* 3/2016 Jung ..... B61L 27/04 701/20
2016/0078695 A1 3/2016 McClintic et al.
2016/0082987 A1* 3/2016 Pulliam ..... B61L 15/00 701/20
2016/0082993 A1* 3/2016 Peltz ..... B61L 25/025 701/32.4
2016/0090112 A1* 3/2016 Smith ..... B61L 15/0072 701/20
2016/0091320 A1* 3/2016 Kapp ..... B61L 3/008 701/1
2016/0096535 A1* 4/2016 Traylor ..... B61L 3/008 701/19
2016/0101792 A1* 4/2016 Bartonek ..... B61L 25/021 701/20
2016/0107665 A1* 4/2016 Dommel ..... B61L 15/009 246/1 R
2016/0121912 A1* 5/2016 Puttagunta ..... B61L 27/04 701/19
2016/0129925 A1* 5/2016 Jensen ..... B61C 17/12 701/19
2016/0129926 A1* 5/2016 Tonosaki ..... B61L 3/006 701/20
2016/0176414 A1* 6/2016 Lamba ..... B61L 25/025 105/35
2016/0176419 A1* 6/2016 Tsuzaka ..... B60L 15/2009 701/20
2016/0176421 A1* 6/2016 King ..... B61L 3/16 701/20
2016/0176422 A1* 6/2016 Cross ..... B61L 15/0027 701/20
2016/0176425 A1* 6/2016 Traylor ..... B61L 15/0081 701/19
2016/0185326 A1* 6/2016 Brooks ..... B60L 15/38 701/19
2016/0194016 A1* 7/2016 Yamanaka ..... B60M 3/00 701/19
2016/0202698 A1* 7/2016 Yamasaki ..... B61L 27/0038 701/2
2016/0207550 A1* 7/2016 Raeder ..... G07C 5/0825
2016/0229422 A1* 8/2016 Schoenly ..... B61C 17/12
2016/0236698 A1* 8/2016 Kupiec ..... B61L 15/0081
2016/0244077 A1* 8/2016 Di Cairano ..... B61L 15/0072
2016/0251025 A1* 9/2016 Oldknow ..... B61L 3/006 701/19
2016/0257309 A1* 9/2016 Kumar ..... G05B 13/021
2016/0257323 A1* 9/2016 Meyer ..... B61L 27/0027
2016/0257324 A1* 9/2016 Kono ..... B61L 25/021
2016/0267391 A1* 9/2016 Cogill ..... G06N 7/005
2016/0290811 A1* 10/2016 Watterson ..... G06Q 10/0833
2016/0297456 A1* 10/2016 Nameki ..... B61L 3/008
2016/0306360 A1* 10/2016 Seaton ..... B61L 25/025
2016/0306960 A1* 10/2016 Gajulapalli ..... G06F 21/44
2016/0332647 A1* 11/2016 Yanai ..... B61L 23/00
2016/0332648 A1* 11/2016 Yu ..... B61L 27/0027
2016/0334055 A1* 11/2016 Strecker ..... H05K 5/0204
2016/0339929 A1* 11/2016 Schoenly ..... B61L 3/006
2016/0339935 A1* 11/2016 Fournier ..... B61L 3/006
2016/0347204 A1* 12/2016 Takigawa ..... B60L 15/40
2016/0347337 A1* 12/2016 Endo ..... B61L 15/009
2016/0355198 A1* 12/2016 Dulmage ..... B61L 3/008
2016/0362022 A1* 12/2016 Mathews, Jr. ..... B60L 15/2018
2016/0362123 A1* 12/2016 Schultz ..... B61L 27/0038
2017/0015337 A1* 1/2017 Seaton ..... B60L 15/2009
2017/0021845 A1* 1/2017 Zhebrak ..... B61L 3/008
2017/0043798 A1* 2/2017 Kawabata ..... B61L 25/025
2017/0057378 A1* 3/2017 Xun ..... B61L 27/0038
2017/0057529 A1* 3/2017 Kubo ..... B61L 27/0022
2017/0059329 A1* 3/2017 Mwakibinga ..... H04R 29/004
2017/0061794 A1* 3/2017 Nishimura ..... B61L 15/0072
2017/0069041 A1* 3/2017 Akiba ..... G08G 7/00
2017/0072974 A1* 3/2017 Morita ..... B61L 27/0027
2017/0096153 A1* 4/2017 Ezawa ..... B61H 13/00
2017/0106884 A1* 4/2017 Oswald ..... B61L 3/008
2017/0106887 A1* 4/2017 Mian ..... G01V 1/181
2017/0106888 A1* 4/2017 Shubs, Jr. ..... B61L 27/02
2017/0110791 A1* 4/2017 Terasawa ..... B60L 15/40
2017/0113708 A1* 4/2017 Ferrari ..... B61L 3/08
2017/0120937 A1* 5/2017 Sameda ..... B61L 3/006
2017/0151965 A1* 6/2017 Brooks ..... B61L 23/00
2017/0158213 A1* 6/2017 Mathews ..... G01C 21/28
2017/0160746 A1* 6/2017 Rao ..... B61L 15/0081
2017/0174236 A1* 6/2017 Worden ..... B60L 15/20
2017/0190340 A1* 7/2017 Jung ..... B61L 27/04
2017/0197645 A1* 7/2017 Voyer ..... B61L 25/021
2017/0203745 A1* 7/2017 Kumar ..... B61L 15/0072
2017/0210401 A1* 7/2017 Mian ..... H04W 4/70
2017/0210404 A1* 7/2017 Brooks ..... B61L 23/007
2017/0214088 A1* 7/2017 Bomkamp ..... H01M 10/0567
2017/0232943 A1* 8/2017 Brooks ..... B61L 25/021 701/19
2017/0232983 A1* 8/2017 Miglianico ..... B61L 3/006 701/19
2017/0232984 A1* 8/2017 Miglianico ..... B61L 3/008 246/182 R
2017/0272351 A1* 9/2017 Wolf ..... B61L 15/0027
2017/0274915 A1* 9/2017 Vargas ..... B61L 15/0072
2017/0282942 A1* 10/2017 Mathews, Jr. ..... B61L 3/008
2017/0297594 A1* 10/2017 Goforth ..... B61L 3/006
2017/0305396 A1* 10/2017 Shiratsuchi ..... B61L 25/026
2017/0305449 A1* 10/2017 Klemanski ..... B61H 9/006
2017/0308080 A1* 10/2017 Brooks ..... G05D 1/0027
2017/0313330 A1* 11/2017 Frenzke ..... B61L 15/0018
2017/0334461 A1* 11/2017 Schoenly ..... B61L 3/16
2017/0337813 A1* 11/2017 Taylor ..... G08G 1/0965
2017/0349195 A1* 12/2017 Benedict ..... B61L 27/0005
2017/0352269 A1* 12/2017 Iwase ..... B61L 15/0072
2018/0001917 A1* 1/2018 Kaede ..... B61L 15/0027
2018/0015937 A1* 1/2018 Woo ..... B61L 27/0038
2018/0029620 A1* 2/2018 Wait ..... B61L 27/0016
2018/0037241 A1* 2/2018 Sharma ..... B61L 3/008
2018/0037243 A1* 2/2018 Danielson ..... B61L 27/0027
2018/0043912 A1* 2/2018 Dulmage ..... G05D 1/0295
2018/0045517 A1* 2/2018 Ahuja ..... B61L 25/025
2018/0060808 A1* 3/2018 Borgerson ..... G06Q 10/0831
2018/0093683 A1* 4/2018 Alonso Garrido .... B61L 23/041
2018/0118238 A1* 5/2018 de Albuquerque Gleizer ..... B61L 3/02
2018/0120862 A1* 5/2018 Dembinski ..... G05D 1/0223
2018/0127005 A1* 5/2018 Yang ..... B61L 3/006
2018/0170412 A1* 6/2018 Fischer ..... B61L 15/0063
2018/0172460 A1* 6/2018 Yano ..... B61L 27/0016
2018/0186390 A1* 7/2018 Lavertu ..... B61L 3/006
2018/0186392 A1* 7/2018 Da Costa ..... B61L 23/007
2018/0194376 A1* 7/2018 Draheim ..... B61L 3/006
2018/0201285 A1* 7/2018 Brooks ..... B61C 17/00
2018/0201288 A1* 7/2018 Wait ..... B61L 27/04
2018/0222500 A1* 8/2018 Voyer ..... B60M 3/06
2018/0222501 A1* 8/2018 Sato ..... H01F 38/14
2018/0222502 A1* 8/2018 Paralikar ..... B61C 15/14
2018/0222504 A1* 8/2018 Birch ..... B61L 23/048
2018/0222505 A1* 8/2018 Chung ..... B61L 27/04
2018/0237039 A1* 8/2018 Mong ..... H04L 67/322
2018/0257682 A1* 9/2018 Brooks ..... B61L 3/006
2018/0265295 A1* 9/2018 Beckman ..... G06Q 10/08345
2018/0265296 A1* 9/2018 Beckman ..... G06Q 10/083
2018/0273064 A1* 9/2018 Brooks ..... B61L 27/0027
2018/0273065 A1* 9/2018 Adomeit ..... B61L 27/0038
2018/0304910 A1* 10/2018 Adomeit ..... B61L 27/0027
2018/0309356 A1* 10/2018 Galic ..... B60L 9/00
2018/0312182 A1* 11/2018 Prestail ..... B61L 27/04
2018/0319412 A1* 11/2018 Horn ..... B61L 27/0027
2018/0327000 A1* 11/2018 Jovenall ..... B61L 15/0027
2018/0327005 A1* 11/2018 Yamamoto ..... B60L 15/20
2018/0327006 A1* 11/2018 Nitti ..... B61L 15/0036
2018/0339719 A1* 11/2018 Loughlin ..... B61L 3/006
2018/0346005 A1* 12/2018 Yanai ..... B60L 15/40
2018/0361878 A1* 12/2018 Akiyama ..... B61C 17/12
2019/0002001 A1* 1/2019 Bhatti ..... B61L 15/009
2019/0009805 A1* 1/2019 Bramlett ..... B61C 11/005

(56) References Cited

U.S. PATENT DOCUMENTS

2019/0016356 A1* 1/2019 Mochimaru ..... B60L 9/00
2019/0016357 A1* 1/2019 Smith ..... B60L 3/0061
2019/0041425 A1* 2/2019 Kitzmueller ..... B61L 3/008
2019/0050220 A1* 2/2019 Daum ..... B61L 15/0072
2019/0054936 A1* 2/2019 Tione ..... B60T 17/228
2019/0071107 A1* 3/2019 Cooper ..... B61L 27/0061
2019/0077426 A1* 3/2019 Nishi ..... B61L 3/006
2019/0077427 A1* 3/2019 Itagaki ..... B60L 15/40
2019/0077431 A1* 3/2019 Mizuno ..... B60L 3/10
2019/0084600 A1* 3/2019 Davidich ..... G06N 3/006
2019/0095725 A1* 3/2019 Kalghatgi ..... G06K 9/00805
2019/0100226 A1* 4/2019 Baier ..... B61L 15/0063
2019/0111787 A1* 4/2019 Tione ..... B60L 3/108
2019/0111951 A1* 4/2019 Tione ..... B61L 3/008
2019/0114914 A1* 4/2019 Gao ..... B61L 23/34
2019/0135311 A1* 5/2019 Zarella ..... B61L 3/006
2019/0144023 A1* 5/2019 Gao ..... B61L 3/008
701/19
2019/0144025 A1* 5/2019 Gao ..... H04W 4/70
701/19
2019/0161101 A1* 5/2019 Brooks ..... B61L 25/025
2019/0161102 A1* 5/2019 Rosti ..... B61L 27/0016
2019/0168789 A1* 6/2019 Tokumaru ..... B61L 27/00
2019/0176859 A1* 6/2019 Shibasaki ..... B61L 15/0063
2019/0193759 A1* 6/2019 Ravi ..... B61L 3/006
2019/0193760 A1* 6/2019 Kumar ..... B61L 3/008
2019/0193764 A1* 6/2019 Cooper ..... B61L 27/0022
2019/0202484 A1* 7/2019 Yamamoto ..... B60L 15/40
2019/0217876 A1* 7/2019 Fujiwara ..... B60L 3/0015
2019/0225247 A1* 7/2019 Garmson ..... B61L 15/0072
2019/0248392 A1* 8/2019 Bar-Tal ..... B61L 15/02
2019/0248394 A1* 8/2019 Khan ..... B61L 25/04
2019/0255956 A1* 8/2019 Okahara ..... B61L 3/006
2019/0263432 A1* 8/2019 Carlson ..... B61L 15/0027
2019/0300028 A1* 10/2019 Okada ..... B60L 15/32
2019/0337390 A1* 11/2019 Koerner ..... B61D 1/00
2019/0359237 A1* 11/2019 Ouyang ..... B61L 25/025
2019/0359238 A1* 11/2019 Ding ..... G06F 3/0481
2019/0367062 A1* 12/2019 Brooks ..... B61L 27/0022
2019/0367064 A1* 12/2019 Gunther ..... B61L 27/0038
2019/0375441 A1* 12/2019 Green ..... B61L 25/025
2020/0001906 A1* 1/2020 Bramucci ..... B61L 25/028
2020/0011282 A1* 1/2020 Wakasugi ..... G06N 20/00
2020/0039543 A1* 2/2020 Fan ..... G06F 16/2237
2020/0055526 A1* 2/2020 Malik ..... B61L 27/0077
2020/0055530 A1* 2/2020 Malik ..... B61K 1/00
2020/0055532 A1* 2/2020 Schultz ..... B61L 25/028
2020/0062287 A1* 2/2020 Jones ..... B61L 27/0011
2020/0070863 A1* 3/2020 Kumar ..... B61C 5/00
2020/0079333 A1* 3/2020 Ballesteros ..... G06Q 50/06
2020/0079404 A1* 3/2020 Tao ..... B60M 1/30
2020/0101991 A1* 4/2020 Tatsumi ..... B61L 27/0094
2020/0108848 A1* 4/2020 Garmson ..... B61L 25/023
2020/0114935 A1* 4/2020 Baughman ..... B61L 27/0022
2020/0122757 A1* 4/2020 Abrosimov ..... B61L 15/0072
2020/0130716 A1* 4/2020 Garmson ..... B61L 3/125
2020/0156675 A1* 5/2020 Mangus ..... B61L 3/006
2020/0156679 A1* 5/2020 Otsuki ..... G06Q 10/06312
2020/0156681 A1* 5/2020 Bienek ..... B61L 3/006
2020/0172131 A1* 6/2020 Kernwein ..... B61L 11/08
2020/0172132 A1* 6/2020 Kernwein ..... B61L 27/0038
2020/0172133 A1* 6/2020 Abrosimov ..... B61L 15/0027
2020/0174994 A1* 6/2020 Huang ..... G08G 1/01
2020/0180665 A1* 6/2020 Hausmann ..... B61L 3/008
2020/0180670 A1* 6/2020 McGavock, Jr. ..... B61L 3/02
2020/0189632 A1* 6/2020 Saxena ..... B61L 23/007
2020/0198474 A1* 6/2020 Amler ..... B60L 9/16
2020/0198673 A1* 6/2020 Green ..... G01C 21/16
2020/0205070 A1* 6/2020 Sienkiewicz ..... H04W 52/02
2020/0207384 A1* 7/2020 Dick ..... B61L 25/025
2020/0207385 A1* 7/2020 Kernwein ..... B61L 15/0027
2020/0223459 A1* 7/2020 Wolff ..... B61C 3/00
2020/0224627 A1* 7/2020 Banerjee ..... F02N 11/006
2020/0256665 A1* 8/2020 Jovenall ..... B61L 3/008
2020/0283037 A1* 9/2020 Dumont ..... G01W 1/02
2020/0284817 A1* 9/2020 Dumont ..... G01P 13/045
2020/0284819 A1* 9/2020 Dumont ..... B61L 15/0072
2021/0107535 A1* 4/2021 Howard ..... B61L 3/006
2021/0107538 A1* 4/2021 Howard ..... B61L 27/0038
2021/0134081 A1* 5/2021 Claussen ..... G07C 5/008

* cited by examiner

VEHICLE CONTROL SYSTEM

CROSS-REFERENCE TO RELATED APPLICATIONS

This application is a continuation-in-part of International Patent Application PCT/US2017/042516, filed 18 Jul. 2017, which claims priority to U.S. patent application Ser. No. 15/231,078 filed 8 Aug. 2016. The entire disclosures of these patent applications are incorporated herein by reference.

FIELD

Embodiments of the subject matter described herein relate to controlling or monitoring a rail vehicle system as the rail vehicle system travels.

BACKGROUND

Some known rail vehicle systems may travel according to a trip plan that provides instructions for the rail vehicle system to implement during movement of the rail vehicle system so that the vehicle system meets or achieves certain objectives during the trip. For example, the trip plan may dictate throttle settings, brake settings, speeds, etc. of the vehicle system as a function of time, location, distance, and/or other parameters. The objectives for the trip may include reaching an arrival location at or before a predefined arrival time, increasing fuel efficiency (relative to the fuel efficiency of the rail vehicle system traveling without following the trip plan), abiding by speed limits and emissions limits, and the like.

For example, the Trip Optimizer™ system of General Electric Company can create a trip plan by collecting various input information related to the rail vehicle system and the trip, such as the length and weight of the rail vehicle system, the grade and conditions of the route that the rail vehicle system will be traversing, weather conditions, performance of the rail vehicle system, or the like. The input information may also include one or more "slow orders" that have been issued for respective segments of the route. A slow order restricts speeds at which a rail vehicle system may travel through the respective segment. A slow order may be applied, for example, to a segment of the route where individuals (e.g., construction workers, inspectors, or the like) may be located near the route or where conditions of the route may be poor (e.g., debris along the route). Presently, slow orders include the location of the segment and the maximum speed at which the rail vehicle system may travel.

A single trip, however, may be hundreds of kilometers or more and include several slow orders. As an example, a single trip may be more than a thousand kilometers and may travel through thirty or more segments with slow orders. Due to the length and duration of the trip, a slow order may have expired when the rail vehicle system arrives at the respective segment. If the operator is aware that the slow order has expired, the operator may break from automatic control and manually control the rail vehicle system through the respective segment. It is generally desirable, however, to increase the time in which the vehicle system is automatically controlled or, for those instances in which the rail vehicle system is controlled manually, to guide the operator along the segment using correct information.

BRIEF DESCRIPTION

In one embodiment, a control system for a rail vehicle system having one or more locomotives moving along a track under a first speed limit is provided. The control system is configured to dictate operational settings to be implemented by the rail vehicle system based at least in part on a transitory second speed limit that is less than or equal to the first speed limit and which is issued for a determined segment of the track and for a determined time period. The time period has a start time and a stop time. The control system also is configured to obtain a current time as the rail vehicle system approaches, enters, or moves through the determined segment, determine whether the transitory second speed limit has started, is in effect, or has expired based on the current time relative to the determined time period, and, in response to such determination, perform one or more of (a) generate a prompt to indicate that the determined time period has expired, (b) operate the rail vehicle system at the first speed limit, and/or (c) modify the operational settings of the rail vehicle system to exceed the second speed limit in the determined segment but not exceed the first speed limit for the determined segment.

In one embodiment, a method includes determining operational settings to be implemented by a rail vehicle system having one or more locomotives moving along a track under a first speed limit. The operational settings are determined based at least in part on a transitory second speed limit that is less than or equal to the first speed limit and which is issued for a determined segment of the track and for a determined time period, the time period having a start time and a stop time. The method also includes obtaining a current time as the rail vehicle system approaches, enters, or moves through the determined segment, determining whether the transitory second speed limit has started, is in effect, or has expired based on the current time relative to the determined time period, and, in response to such determination, performing one or more of (a) generating a prompt to indicate that the determined time period has expired, (b) operating the rail vehicle system at the first speed limit, or (c) modifying the operational settings of the rail vehicle system to exceed the second speed limit in the determined segment but not exceed the first speed limit for the determined segment.

In one embodiment, a control system is configured to determine operational settings to be implemented by a rail vehicle system having one or more locomotives moving along track. The operational settings are determined based on a temporary work order issued for a restricted segment of the track. The temporary work order provides a reduced speed limit for travel through the restricted segment for a defined time period. One or more of the operational settings specify movement of the rail vehicle system through the restricted segment at a vehicle speed that is less than or equal to the reduced speed limit. The control system also is configured to control the rail vehicle system in accordance with the operational settings as the rail vehicle system moves along the track to travel within the restricted segment at the vehicle speed that is less than or equal to the reduced speed limit, determine a current time as the rail vehicle system moves through the restricted segment, determine that the temporary work order has expired based on the current time and the limited time period of the temporary work order, and, in response to determining that the temporary work order has expired, prompt an operator of the rail vehicle system to confirm that the temporary work order has expired or determine updated operational settings to be implemented by the rail vehicle system to move faster than the reduced speed limit in the restricted segment.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
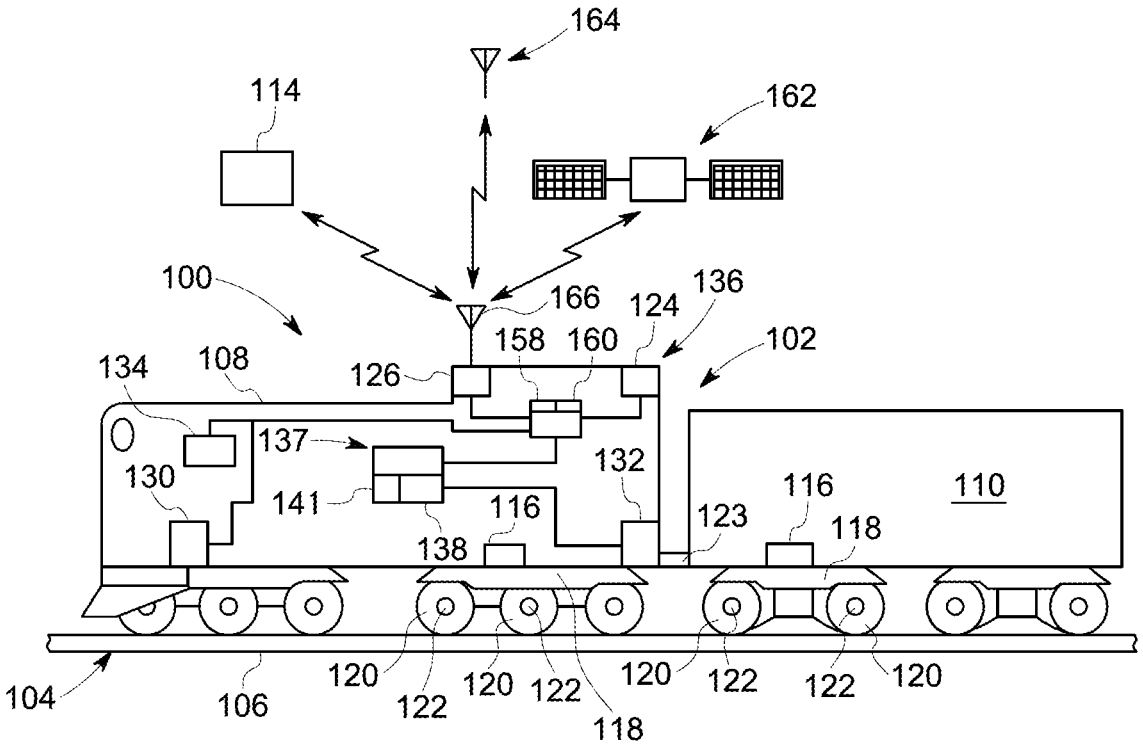
FIG. 1 is a schematic diagram of one embodiment of a control system disposed onboard a rail vehicle system.

Embodiments of the subject matter disclosed herein describe methods and systems used in conjunction with controlling a rail vehicle system that travels along routes. The embodiments provide methods and systems for controlling the rail vehicle system along the route after determining that a temporary work order issued for a segment of the route has expired and/or after determining that the temporary work order has not yet expired. In particular, embodiments may modify or re-generate trip plans and/or reduce an amount of time spent manually controlling the vehicle system.

A more particular description of the inventive subject matter briefly described above will be rendered by reference to specific embodiments thereof that are illustrated in the appended drawings. The inventive subject matter will be described and explained with the understanding that these drawings depict only typical embodiments of the inventive subject matter and are not therefore to be considered to be limiting of its scope. Wherever possible, the same reference numerals used throughout the drawings refer to the same or like parts. To the extent that the figures illustrate diagrams of the functional blocks of various embodiments, the functional blocks are not necessarily indicative of the division between hardware and/or circuitry. Thus, for example, components represented by multiple functional blocks (for example, processors, controllers, or memories) may be implemented in a single piece of hardware (for example, a general-purpose signal processor, microcontroller, random access memory, hard disk, or the like). Similarly, any programs and devices may be standalone programs and devices, may be incorporated as subroutines in an operating system, may be functions in an installed software package, or the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

As used herein, the terms "module," "system," "device," or "unit," may include a hardware and/or software system and circuitry that operate to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

As used herein, an "embedded system" is a specialized computing system that is integrated as part of a larger system, such as a larger computing system (e.g., control system) or a vehicle system. An embedded system includes a combination of hardware and software components that form a computational engine that will perform one or more specific functions. Embedded systems are unlike general computers, such as desktop computers, laptop computers, or tablet computers, which may be programmed or re-programmed to accomplish a variety of disparate tasks. Embedded systems include one or more processors (e.g., microcontroller or microprocessor) or other logic-based devices and memory (e.g., volatile and/or non-volatile) and may optionally include one or more sensors, actuators, user interfaces, analog/digital (AD), and/or digital/analog (DA) converters. An embedded system may include a clock (referred to as system clock) that is used by the embedded system for performing its intended function(s), recording data, and/or logging designated events during operation.

Embedded systems described herein include those that may be used to control a rail vehicle system, such as a locomotive or a consist that includes the locomotive. These embedded systems are configured to operate in time-constrained environments, such as those experienced during a trip, that require the embedded systems to make complex calculations that a human would be unable to perform in a commercially reasonable time. Embedded systems may also be reactive such that the embedded systems change the performance of one or more mechanical devices (e.g., traction motors, braking subsystems) in response to detecting an operating condition. Embedded systems may be discrete units. For example, at least some embedded systems may be purchased and/or installed into the larger system as separate or discrete units.

Non-limiting examples of embedded systems that may be used by a vehicle system, such as those described herein, include a communication management unit (CMU), a consolidated control architecture (CCA), a locomotive command and control module (LCCM), a high-performance extended applications platform (HPEAP), and an energy management system (EMS). Such embedded systems may be part of a larger system, which may be referred to as a control system. The larger system may also be the vehicle system (e.g., locomotive). In certain embodiments, the CMU is configured to communicate with an off-board system, such as a dispatch, and generate a trip plan based on input information received from the off-board system. In certain embodiments, the CCA may implement or execute the trip plan by controlling one or more traction motors and braking subsystems. The CCA may receive the trip plan from the CMU and communicate with the CMU as the vehicle system moves along the route. For example, the CMU may communicate a current time to the CCA.

As described herein, the system (e.g., the control system or the rail vehicle system) is configured to implement a trip plan that is based on a temporary work order that has been issued for a restricted segment of the route or to otherwise control movement of the rail vehicle system based on the work order (without reference to or use of a trip plan). A temporary work order can be any issued temporary order, restriction, instruction, rule, or the like that instructs or requires the rail vehicle system to move at or less than a designated vehicle speed limit that is different that the vehicle speed limit that is ordinarily (e.g., otherwise) applied to the restricted segment. For example, the temporary work order may be issued by a railroad or government agency and may be issued for a variety of reasons (e.g., safety of personnel working alongside the route, safety of individuals and cargo on the vehicle system, etc.). Optionally, a control system onboard one or more of the vehicle systems may issue or create the work order.

A temporary work order includes, for example, a slow order or a designated temporary work zone. In some applications, the trip plan may be implemented differently based on the type of temporary work order. For example, the trip plan may require that the vehicle system operate in a manual mode along the restricted segment for a first type of temporary work order (e.g., temporary work zone), but operate in an autonomous mode for a second type of temporary work order (e.g., slow order). Accordingly, portions of the trip plan may be implemented manually by an operator or autonomously by the vehicle system. In other embodiments, the entire trip plan is implemented autonomously by the vehicle system. The operator may interrupt automatic control, if necessary.

As used herein, a "restricted segment" refers to a segment of the route that has a temporary work order (e.g., slow order, temporary work zone) issued therefor or applied thereto. The restricted segment has a distance that is less than the entire route and, in many cases, significantly less. For example, the route for the trip may be hundreds or thousands of kilometers (km). The restricted segment, however, may be only 1-10 km. It should be understood that the length or distance of the restricted segment may be less than 1 km or more than 10 km. It should also be understood that a single trip may include more than one restricted segment. For example, a single trip may include several restricted segments (e.g., four or more restricted segments) along the route. In other embodiments, the trip may include three or fewer restricted segments.

The temporary work order specifies one or more speed limits, such as a maximum speed, for moving through the restricted segment (e.g., at most 50 km/hour (kph)). Alternatively, the speed limit specified by the work order can be a temporary speed limit that differs from the ordinary or pre-existing speed limit of the same segment of the route. For example, the segment of a route may have a speed limit that restricts vehicle systems from legally moving faster than the speed limit while traveling along or through that segment of the route. Implementation of a temporary work order may reduce this speed limit to a lower speed limit such that vehicle systems cannot legally move through the segment faster than the lower speed limit while the temporary work order is in place. Upon expiration of the work order, the lower speed limit of the segment can return to the speed limit that was in force prior to the start of the work order.

The temporary work order also specifies a beginning point (e.g., geographic location) of the restricted segment along the route and an end point (e.g., a different geographic location) of the restricted segment along the route. For example, the beginning points and end points may be identified by markers (e.g., mile markers) along the route, geographical coordinates (e.g., latitude/longitude coordinates), landmarks, track features (e.g., junctions), or other data that identifies where the restricted segment is located along the route. The maximum speed is less than a speed at which the vehicle system may typically pass along the same restricted segment when a temporary work order is not applied. For example, if the vehicle system is permitted to move at 80 kph or less when the temporary work order is not applied, the maximum speed provided by the temporary work order is less (e.g., at most 60 kph, at most 50 kph, at most 40 kph, at most 30 kph, at most 20 kph, etc.). It should be understood that units or speeds may also be expressed in miles (e.g., miles/hour).

The temporary work order may also specify a limited time period in which the temporary work order is applied or is valid for the restricted segment. The limited time period may be expressed in a designated time standard. The designated time standard may be a predetermined time standard, such as the coordinated universal time (UTC). One example of a limited time period is 13:00-18:00 UTC. Alternatively, the designated time standard may also be the local time. For example, when the restricted segment is located within the Eastern Time Zone of the United States in an area that observes standard time (autumn/winter), the designated time standard is the Eastern Standard Time (EST), which is 5 hours behind UTC. Another example of a limited time period is 1:00 pm-6:00 pm EST. Accordingly, a temporary work order issued for a restricted segment may (a) specify the beginning point and end point of the restricted segment; (b) specify the maximum speed at which the vehicle system may move through the restricted segment; and (c) specify the limited time period at which the temporary work order is valid.

Embodiments may determine a current time as the vehicle system moves along the route. As used herein, the "current time" is either expressed in the designated time standard or expressed in a different time standard that is a function of the designated time standard. For example, if the designated time standard is a regional time standard of the geographical region that includes the restricted segment (e.g., EST), the current time may be expressed in EST or in UTC, which has a known relationship with respect to EST. More specifically, UTC is five hours ahead of EST.

Temporary work orders may correspond to overlapping or non-overlapping restricted segments. For example, a temporary work order may be issued for a restricted segment that extends from a beginning point at 10 km to an end point at 12 km. Another temporary work order may be issued for a restricted segment that extends from a beginning point at 12 km to an end point at 15 km. These restricted segments are non-overlapping. As another example, a temporary work order may be issued for a restricted segment that extends from a beginning point at 15 km to an end point at 20 km. Another temporary work order may be issued for a restricted segment that extends from a beginning point at 18 km to an end point at 22 km. Such restricted segments are overlapping. In many cases, the restricted segments along a route are separate from each other. For example, a first restricted segment may extend from a beginning point at 30 km to an end point at 32 km and the next restricted segment may extend from a beginning point at 55 km to an end point at 60 km. In between these restricted segments, the vehicle system may be permitted to travel at a maximum speed that is typically applicable for the segment between the restricted segments.

Embodiments that include trains may be particularly suitable for routes that do not include a positive train control (PTC) infrastructure. PTC is configured to prevent train-to-train collisions, overspeed derailments, incursions into established work zone limits, and the movement of a train through a switch left in the wrong position. A PTC system may utilize wireless communication to provide in-cab signals to a human operator (e.g., train engineer) and to enable a dispatcher to stop a train remotely in an emergency. A PTC system is a communication and signaling system that uses signals and sensors along a route to communicate a train location, speed restrictions, and moving authority. If the locomotive is violating a speed restriction or moving authority, onboard equipment may automatically slow or stop the train.

FIG. 1 illustrates a schematic diagram of a control system 100 according to an embodiment. The control system 100 is disposed on a rail vehicle system 102. The vehicle system 102 is configured to travel on a route 104. The vehicle system 102 is configured to travel along the route 104 on a trip from a starting or departure location to a destination or arrival location. The vehicle system 102 includes a propulsion-generating vehicle 108 and a non-propulsion-generating vehicle 110 that are mechanically interconnected to one another to travel together along the route 104. Two or more coupled propulsion-generating vehicles 108 may form a consist or group. The vehicle system 102 may include a single consist or multiple consists interspersed along the vehicle system 102. In a distributed power operation, the consist may include a lead propulsion-generating vehicle mechanically linked to one or more remote propulsion-generating vehicles, where operational settings (e.g., tractive and braking settings) of the remote propulsion-generating vehicles are controlled by the lead propulsion-generating vehicle. Alternatively, the vehicle system 102 may be formed from a single propulsion-generating vehicle 108.

Optionally, the vehicle system 102 may be formed from two or more vehicles 108 that are not mechanically coupled with each other. Instead, these vehicles 108 can be logically coupled with each other. The vehicles 108 can be logically coupled by the control systems onboard the vehicles 108 communicating with each other (e.g., using wireless communication between the vehicles 108) so that the vehicles 108 can change and control the separate movements of the vehicles 108 based on each other's movements. For example, the control systems of the vehicles 108 communicate with each other to coordinate the movements of the vehicles 108 so that the vehicles 108 move together along routes without all the vehicles 108 being directly or indirectly mechanically coupled with each other. This allows for the vehicles 108 to travel in a convoy or platoon along the route(s) without the separate vehicles 108 pulling and/or pushing one another along the route(s).

The propulsion-generating vehicle 108 is configured to generate tractive efforts to propel (for example, pull and/or push) the non-propulsion-generating vehicle 110 along the route 104. The propulsion-generating vehicle 108 includes a propulsion subsystem, including one or more traction motors, that generates tractive effort to propel the vehicle system 102. The propulsion-generating vehicle 108 also includes a braking subsystem that generates braking effort for the vehicle system 102 to slow down or stop itself from moving. Optionally, the non-propulsion-generating vehicle 110 includes a braking subsystem but not a propulsion subsystem. The propulsion-generating vehicle 108 is referred to herein as a propulsion vehicle 108, and the non-propulsion-generating vehicle 110 is referred to herein as a car 110. Although one propulsion vehicle 108 and one car 110 are shown in FIG. 1, the vehicle system 102 may include multiple propulsion vehicles 108 and/or multiple cars 110. In an alternative embodiment, the vehicle system 102 only includes the propulsion vehicle 108 such that the propulsion vehicle 108 is not coupled to the car 110 or another kind of vehicle.

The control system 100 is used to control the movements of the vehicle system 102. In the illustrated embodiment, the control system 100 is disposed entirely on the propulsion vehicle 108. The control system 100 may include a plurality of embedded sub-systems, which are hereinafter referred to as embedded systems. In other embodiments, however, one or more components of the control system 100 may be distributed among several vehicles, such as the vehicles 108, 110 that make up the vehicle system 102. For example, some components may be distributed among two or more propulsion vehicles 108 that are coupled together in a group or consist. In an alternative embodiment, at least some of the components of the control system 100 may be located remotely from the vehicle system 102, such as at a dispatch location 114. The remote components of the control system 100 may communicate with the vehicle system 102 (and with components of the control system 100 disposed thereon).

In the illustrated embodiment, the vehicle system 102 is a rail vehicle system, and the route 104 is a track formed by one or more rails 106. The propulsion vehicle 108 may be a rail vehicle (e.g., locomotive), and the car 110 may be a rail car that carries passengers and/or cargo. The propulsion vehicle 108 may be another type of rail vehicle other than a locomotive. In another embodiment, the propulsion-generating vehicles 108 may be trucks and/or automobiles configured to drive on a track 106 composed of pavement (e.g., a highway). The vehicle system 102 may be a group or consist of trucks and/or automobiles that are logically coupled to coordinate movement of the vehicles 108 along the pavement. In other embodiments, the vehicles 108 may be off-highway vehicles (e.g., mining vehicles and other vehicles that are not designed for or permitted to travel on public roadways) traveling on a track 106 of earth, marine vessels traveling on a track 106 of water (e.g., a water route, such as a shipping route), aerial vehicles traveling on a track 106 of air (e.g., an airborne path), or the like. Thus, although some embodiments of the inventive subject matter may be described herein with respect to trains, locomotives, and other rail vehicles, embodiments of the inventive subject matter also are applicable for use with vehicles generally.

The vehicles 108, 110 of the vehicle system 102 each include multiple wheels 120 that engage the route 104 and at least one axle 122 that couples left and right wheels 120 together (only the left wheels 120 are shown in FIG. 1). Optionally, the wheels 120 and axles 122 are located on one or more trucks or bogies 118. Optionally, the trucks 118 may be fixed-axle trucks, such that the wheels 120 are rotationally fixed to the axles 122, so the left wheel 120 rotates the same speed, amount, and at the same times as the right wheel 120. The propulsion vehicle 108 is mechanically coupled to the car 110 by a coupler 123. The coupler 123 may have a draft gear configured to absorb compression and tension forces to reduce slack between the vehicles 108, 110. Although not shown in FIG. 1, the propulsion vehicle 108 may have a coupler located at a front end 125 of the propulsion vehicle 108 and/or the car 110 may have a coupler located at a rear end 127 of the car 110 for mechanically coupling the respective vehicles 108, 110 to additional vehicles in the vehicle system 102. Alternatively, the vehicle 108 may not have any coupler 123 for connecting with another vehicle 108 and/or 110.

As the vehicle system 102 travels along the route 104 during a trip, the control system 100 may be configured to measure, record, or otherwise receive and collect input information about the route 104, the vehicle system 102, and the movement of the vehicle system 102 on the route 104. For example, the control system 100 may be configured to monitor a location of the vehicle system 102 along the route 104 and a speed at which the vehicle system 102 moves along the route 104, which is hereinafter referred to as a vehicle speed.

Additionally, the control system 100 may be configured to generate a trip plan and/or a control signal based on such input information. The trip plan and/or control signal designates one or more operational settings for the vehicle system 102 to implement or execute during the trip as a function of time, location, and/or distance along the route 104. The operational settings may include tractive settings, braking settings, speeds, etc., for the vehicle system 102. For example, the operational settings may include dictated speeds, throttle settings, brake settings, accelerations, or the like, of the vehicle system 102 as a function of time, location, and/or distance along the route 104 traversed by the vehicle system 102.

The trip plan is configured to achieve or increase specific goals or objectives during the trip of the vehicle system 102, while meeting or abiding by designated constraints, restrictions, and limitations. Some possible objectives include increasing energy (e.g., fuel) efficiency, reducing emissions generation, reducing trip duration, increasing fine motor control, reducing wheel and route wear, and the like. The constraints or limitations include speed limits, schedules (such as arrival times at various designated locations), environmental regulations, standards, and the like. The operational settings of the trip plan are configured to increase the level of attainment of the specified objectives relative to the vehicle system 102 traveling along the route 104 for the trip according to operational settings that differ from the one or more operational settings of the trip plan (e.g., such as if the human operator of the vehicle system 102 determines the tractive and brake settings for the trip). One example of an objective of the trip plan is to increase fuel efficiency (e.g., by reducing fuel consumption) during the trip. By implementing the operational settings designated by the trip plan, the fuel consumed may be reduced relative to travel of the same vehicle system along the same segment of the route in the same time period but not according to the trip plan.

The trip plan may be established using an algorithm based on models for vehicle behavior for the vehicle system 102 along the route. The algorithm may include a series of non-linear differential equations derived from applicable physics equations with simplifying assumptions, such as described in connection with U.S. patent application Ser. No. 12/955,710, U.S. Pat. No. 8,655,516, entitled "Communication System for a Rail Vehicle Consist and Method for Communicating with a Rail Vehicle Consist," which was filed 29 Nov. 2010 (the "'516 Patent"), the entire disclosure of which is incorporated herein by reference.

In one embodiment, the control system 100 uses information received from the PTC system to create and/or modify a trip plan. For example, the PTC system may inform the control system 100 of a work order, the presence of another vehicle system on an upcoming route segment, or the like. Based on this information, the control system 100 may be forced by the PTC system to reduce the speed of the vehicle system and/or stop movement of the vehicle system. The control system 100 can modify and/or create the trip plan using this PTC information. For example, automatically slowing the vehicle system due to the PTC system may require the control system 100 to modify an existing trip plan. The control system 100 can change the trip plan to make up for lost time due to the unplanned need to slow down from the PTC system.

The control system 100 may be configured to control the vehicle system 102 along the trip based on the trip plan, such that the vehicle system 102 travels according to the trip plan. In a closed loop mode or configuration, the control system 100 may autonomously control or implement propulsion and braking subsystems of the vehicle system 102 consistent with the trip plan, without requiring the input of a human operator. In an open loop coaching mode, the operator is involved in the control of the vehicle system 102 according to the trip plan. For example, the control system 100 may present or display the operational settings of the trip plan to the operator as directions on how to control the vehicle system 102 to follow the trip plan. The operator may then control the vehicle system 102 in response to the directions. As an example, the control system 100 may be or include a Trip Optimizer™ system from General Electric Company, or another energy management system. For additional discussion regarding a trip plan, see the '516 Patent.

Alternatively, the control system 100 may control the vehicle system 102 outside of a pre-planned trip and/or without use of a trip plan. For example, the control system 100 can receive manual inputs from the operator and change throttle settings, brake settings, speeds, etc., accordingly based on the manual inputs. As another example, the control system 100 can receive sensor inputs of the moving speed of the vehicle system 102, the presence (or absence) of other vehicles or objects on the same route and/or within a designated distance of the vehicle system 102, weather conditions, time-of-day, work orders, or the like, and automatically control movement of the vehicle system 102 based on the sensor inputs.

The control system 100 may include at least on embedded system. In the illustrated embodiment, the control system 100 includes a first embedded system 136 and a second embedded system 137 that are communicatively coupled to each other. Although the control system 100 is shown as having only two embedded systems, it should be understood that the control system 100 may have more than two embedded systems. In certain embodiments, the first embedded system 136 may be a CMU and the second embedded system 137 may be a CCA.

The first embedded system 136 includes one or more processors 158 and memory 160. The one or more processors 158 may generate a trip plan based on input information received from the second embedded system 137 or other components of the vehicle system 102 and/or input information received from a remote location. As used herein, a trip plan is "generated" when an entire trip plan is created (e.g., a new trip plan is created) or an existing plan is modified based on, for example, recently received input information. For example, a new trip plan may be generated after determining that a temporary work order is no longer valid. The new trip plan may be based on the trip plan that the vehicle system was implementing prior to determining that the temporary work order is no longer valid.

The first embedded system 136 may be configured to communicatively couple to a wireless communication system 126. The wireless communication system 126 includes an antenna 166 and associated circuitry that enables wireless communications with global positioning system (GPS) satellites 162, a remote (dispatch) location 114, and/or a cell tower 164. For example, first embedded system 136 may include a port (not shown) that engages a respective connector that communicatively couples the one or more processors 158 and/or memory 160 to the wireless communication system 126. Alternatively, the first embedded system 136 may include the wireless communication system 126. The wireless communication system 126 may also include a receiver and a transmitter, or a transceiver that performs both receiving and transmitting functions.

Optionally, the first embedded system 136 is configured to communicatively couple to or includes a locator device 124. The locator device 124 is configured to determine a location of the vehicle system 102 on the route 104. The locator device 124 may be a global positioning system (GPS) receiver. In such embodiments, one or more components of the locator device may be shared with the wireless communication system 126. Alternatively, the locator device 124 may include a system of sensors including wayside devices (e.g., including radio frequency automatic equipment identification (RF AEI) tags), video or image acquisition devices, or the like. The locator device 124 may provide a location parameter to the one or more processors 158, where the location parameter is associated with a current location of the vehicle system 102. The location parameter may be communicated to the one or more processors 158 periodically or upon receiving a request. The one or more processors 158 may use the location of the vehicle system 102 to determine the proximity of the vehicle system 102 to one or more designated locations of the trip. For example, the designated locations may include points along the route that are proximate to restricted segments or within the restricted segments. The designated locations may also include an arrival location at the end of the trip, a passing loop location along the route 104 where another vehicle system on the route 104 is scheduled to pass the vehicle system 102, a break location for re-fueling, crew change, passenger change, or cargo change, and the like.

Also shown, the second embedded system 137 includes one or more processors 138 and memory 141. Optionally, the second embedded system 137 is configured to communicatively couple to multiple sensors 116, 132. For example, the second embedded system 137 may include ports (not shown) that engage respective connectors that are operably coupled to the sensors 116, 132. Alternatively, the second embedded system 137 may include the sensors 116, 132.

The multiple sensors are configured to monitor operating conditions of the vehicle system 102 during movement of the vehicle system 102 along the route 104. The multiple sensors may monitor data that is communicated to the one or more processors 138 of second embedded system 137 for processing and analyzing the data. For example, the sensor 116 may be a speed sensor 116 that is disposed on the vehicle system 102. In the illustrated embodiment, the speed sensors 116 are located on or near the trucks 118. Each speed sensor 116 is configured to monitor a speed of the vehicle system 102 as the vehicle system 102 traverses the route 104. The speed sensor 116 may be a speedometer, a vehicle speed sensor (VSS), tachometer, global positioning system receiver, dead reckoning system, or the like. The speed sensor 116 may provide a speed parameter to the one or more processors 138, where the speed parameter is associated with a current speed of the vehicle system 102. The speed parameter may be communicated to the one or more processors 138 periodically, such as once every second or every two seconds, or upon receiving a request for the speed parameter.

The sensors 132 may measure other operating conditions or parameters of the vehicle system 102 during the trip (e.g., besides or in addition to speed and/or location). The sensors 132 may include throttle and brake position sensors that monitor the positions of manually-operated throttle and brake controls, respectively, and communicate control signals to the respective propulsion and braking subsystems. The sensors 132 may also include sensors that monitor power output by the motors of the propulsion subsystem and the brakes of the braking subsystem to determine the current tractive and braking efforts of the vehicle system 102. Furthermore, the sensors 132 may include string potentiometers (referred to herein as string pots) between at least some of the vehicles 108, 110 of the vehicle system 102, such as on or proximate to the couplers 123. The string pots may monitor a relative distance and/or a longitudinal force between two vehicles. For example, the couplers 123 between two vehicles may allow for some free movement or slack of one of the vehicles before the force is exerted on the other vehicle. As the one vehicle moves, longitudinal compression and tension forces shorten and lengthen the distance between the two vehicles like a spring. The string pots are used to monitor the slack between the vehicles of the vehicle system 102. The above represents a short list of possible sensors that may be on the vehicle system 102 and used by the second embedded system 137 (or the control system 100 more generally), and it is recognized that the second embedded system 137 and/or the control system 100 may include more sensors, fewer sensors, and/or different sensors.

Other sensors can include a communication device that receives weather conditions from an external source (e.g., a weather reporting service). For example, a wireless transceiver can receive reports of weather conditions. A light sensor can measure the amount of light outside the vehicle (which can indicate reduced visibility, such as during foggy weather).

In an embodiment, the control system 100 includes a vehicle characterization element 134 that provides information about the vehicle system 102. The vehicle characterization element 134 provides information about the make-up of the vehicle system 102, such as the type of cars 110 (for example, the manufacturer, model, the product number, the materials, etc.), the number of cars 110, the weight of cars 110, whether the cars 110 are consistent (meaning relatively identical in weight and distribution throughout the length of the vehicle system 102) or inconsistent, the type and weight of cargo (e.g., liquid versus solid, persons versus materials, perishable versus non-perishable, hazardous versus non-hazardous, etc.), the total weight of the vehicle system 102, the number of propulsion vehicles 108, the position and arrangement of propulsion vehicles 108 relative to the cars 110, the type of propulsion vehicles 108 (including the manufacturer, the product number, power output capabilities, available notch settings, fuel usage rates, etc.), and the like. The vehicle characterization element 134 may be a database stored in an electronic storage device, or memory. The information in the vehicle characterization element 134 may be input using an input/output (I/O) device (referred to as a user interface device) by an operator, may be automatically uploaded, or may be received remotely via the communication system 126. The source for at least some of the information in the vehicle characterization element 134 may be a vehicle manifest, a log, or the like.

The control system 100 further includes a trip characterization element 130. The trip characterization element 130 is configured to provide information about the trip of the vehicle system 102 along the route 104. The trip information may include route characteristics, designated locations, designated stopping locations, schedule times, meet-up events, directions along the route 104, and the like. For example, the designated route characteristics may include grade, elevation slow warnings, environmental conditions (e.g., rain and snow), and curvature information. The designated locations may include the locations of wayside devices, passing loops, re-fueling stations, passenger, crew, and/or cargo changing stations, and the starting and destination locations for the trip. At least some of the designated locations may be designated stopping locations where the vehicle system 102 is scheduled to come to a complete stop for a period of time. For example, a passenger changing station may be a designated stopping location, while a wayside device may be a designated location that is not a stopping location. The wayside device may be used to check on the on-time status of the vehicle system 102 by comparing the actual time at which the vehicle system 102 passes the designated wayside device along the route 104 to a projected time for the vehicle system 102 to pass the wayside device according to the trip plan. The trip information concerning schedule times may include departure times and arrival times for the overall trip, times for reaching designated locations, and/or arrival times, break times (e.g., the time that the vehicle system 102 is stopped), and departure times at various designated stopping locations during the trip. The meet-up events include locations of passing loops and timing information for passing, or getting passed by, another vehicle system on the same route. The directions along the route 104 are directions used to traverse the route 104 to reach the destination or arrival location. The directions may be updated to provide a path around a congested area or a construction or maintenance area of the route. The trip characterization element 130 may be a database stored in an electronic storage device, or memory. The information in the trip characterization element 130 may be input via the user interface device by an operator, may be automatically uploaded, or may be received remotely via the communication system 126. The source for at least some of the information in the trip characterization element 130 may be a trip manifest, a log, or the like.

The first embedded system 136 is a hardware and/or software system that is communicatively coupled to or includes the trip characterization element 130 and the vehicle characterization element 134. The first embedded system 136 may also be communicatively coupled to the second embedded system 137 and/or individual components of the second embedded system 137, such as the sensors 116, 132, 123. The one or more processors 158 receives input information from components of the control system 100 and/or from remote locations, analyzes the received input information, and generates operational settings for the vehicle system 102 to control the movements of the vehicle system 102. The operational settings may be contained in a trip plan. The one or more processors 158 may have access to, or receives information from, the speed sensor 116, the locator device 124, the vehicle characterization element 134, the trip characterization element 130, and at least some of the other sensors 132 on the vehicle system 102. The first embedded system 136 may be a device that includes a housing with the one or more processors 158 therein (e.g., within a housing). At least one algorithm operates within the one or more processors 158. For example, the one or more processors 158 may operate according to one or more algorithms to generate a trip plan.

By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. Memory, such as the memory 140, 160, can include a tangible, non-transitory computer-readable storage medium that stores data on a temporary or permanent basis for use by the one or more processors. The memory may include one or more volatile and/or non-volatile memory devices, such as random-access memory (RAM), static random-access memory (SRAM), dynamic RAM (DRAM), another type of RAM, read only memory (ROM), flash memory, magnetic storage devices (e.g., hard discs, floppy discs, or magnetic tapes), optical discs, and the like.

In an embodiment, using the information received from the speed sensor 116, the locator device 124, the vehicle characterization element 134, trip characterization element 130, and/or other sensors, the first embedded system 136 is configured to designate one or more operational settings for the vehicle system 102 as a function of time and/or distance along the route 104 during a trip. The one or more operational settings are designated to drive or control the movements of the vehicle system 102 during the trip toward achievement of one or more objectives for the trip.

The operational settings may be one or more of speeds, throttle settings, brake settings, or accelerations for the vehicle system 102 to implement during the trip. Optionally, the one or more processors 138 may be configured to communicate at least some of the operational settings designated by the trip plan. The control signal may be directed to the propulsion subsystem, the braking subsystem, or a user interface device of the vehicle system 102. For example, the control signal may be directed to the propulsion subsystem and may include notch throttle settings of a traction motor for the propulsion subsystem to implement autonomously upon receipt of the control signal. In another example, the control signal may be directed to a user interface device that displays and/or otherwise presents information to a human operator of the vehicle system 102. The control signal to the user interface device may include throttle settings for a throttle that controls the propulsion subsystem, for example. The control signal may also include data for displaying the throttle settings visually on a display of the user interface device and/or for alerting the operator audibly using a speaker of the user interface device. The throttle settings optionally may be presented as a suggestion to the operator, for the operator to decide whether or not to implement the suggested throttle settings.

At least one technical effect of various examples of the inventive subject matter described herein may include an increased amount of automatic control time in which the human operator of the vehicle system does not manually control the vehicle system. Another technical effect may include generating, upon determining that a temporary work order is invalid, a new trip plan that is configured to have at least one of (a) a predicted trip duration that is essentially equal to the predicted trip duration of a prior trip plan or (b) a predicted fuel consumption that is less than the first predicted fuel consumption of the prior trip plan. Another technical effect may be providing information to the human operator for guiding the human operator for manually controlling the vehicle system through a restricted segment (or segment that is no longer associated with a temporary work order).

Figure 2:
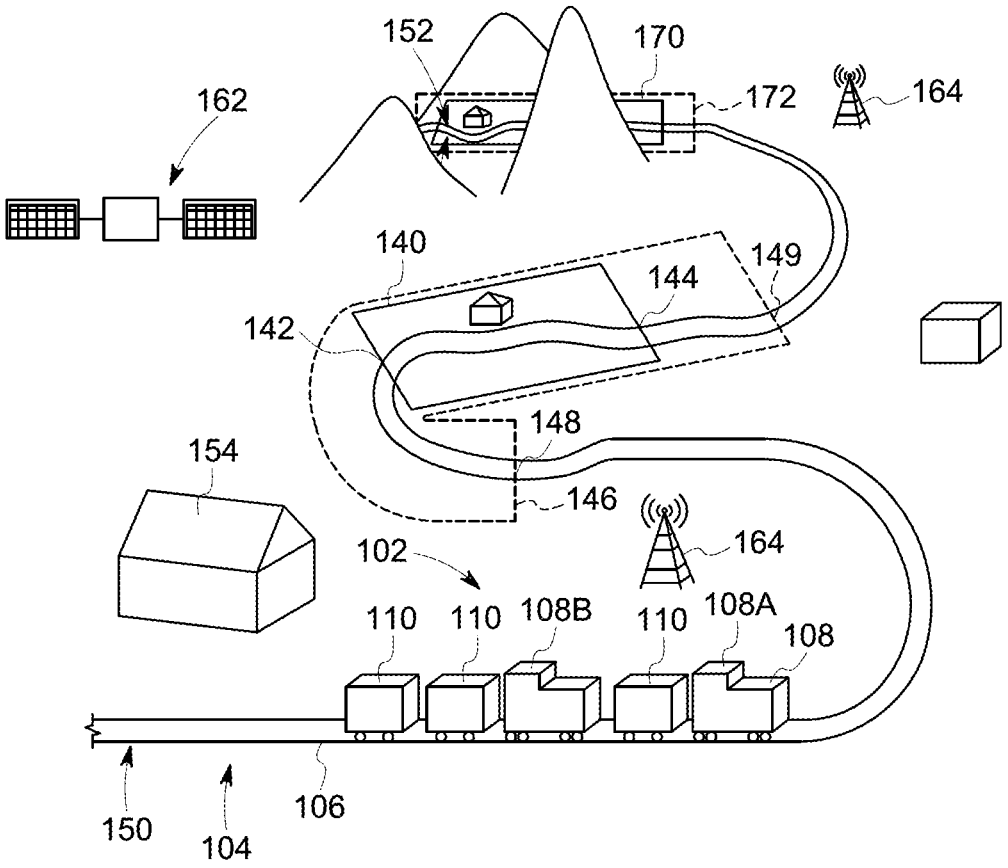
FIG. 2 is an illustration of a rail vehicle system traveling along a route in accordance with an embodiment.

FIG. 2 is an illustration of the vehicle system 102 traveling along the route 104 in accordance with an embodiment. As described above with respect to FIG. 1, the vehicle system 102 includes propulsion-generating vehicles 108A, 108B and three non-propulsion-generating vehicles 110. At least one of the propulsion-generating vehicles 108A, 108B includes the control system 100 (FIG. 1). The route 104 extends from a starting location 150 to a final destination location 152. The vehicle system 102 starts a trip along the route 104 at the starting location 150 and completes the trip at the final destination location 152. For example, the starting location 150 may be at or near a port, and the final destination location 152 may be at or near a mine, such as when the vehicle system 102 is set to travel from the port to the mine to receive a load of cargo at the mine to be transported back to the port. The trip may be, for example, tens, hundreds, or thousands of kilometers (or miles). A trip duration that is measured from the starting location 150 to the destination location 152 may be minutes or hours (e.g., 6 hours, 8 hours, 10 hours, 12 hours, or more).

In some embodiments, a trip represents the journey between a point at which the vehicle system begins moving and a point at which the vehicle system stops moving. In some embodiments, the trip includes all the travel that a vehicle system 102 accomplishes in a single day. In other embodiments, however, a trip may only be one of multiple trips that are traveled in a single day by a vehicle system. For example, a vehicle system 102 may make three six-hour trips in a single day or four four-hour trips in a single day. As such, the term "trip" may be a portion of a longer trip or journey. The trip may be a pre-planned trip (where the starting location, end location, and routes to travel on from the starting location to the end location are known and previously identified before reaching the routes and/or end location). Alternatively, the trip may not be a pre-planned trip such that the routes to be traveled upon and/or end location are not known or set before embarking on the trip.

The vehicle system 102 may communicate wirelessly with an off-board system 154, the GPS satellites 162, and/or cell towers 164. Prior to the vehicle system 102 departing for the trip and/or as the vehicle system 102 moves along the route 104, the vehicle system 102 may be configured to communicate with the off-board system 154. The off-board system 154 may be configured to receive a request for trip data from the vehicle system 102, interpret and process the request, and transmit input information back to the vehicle system 102 in a response. The input information (or trip data) may include trip information, vehicle information, track information, and the like that may be used by the vehicle system 102 to generate a trip plan. As described above, the trip plan may be generated by the first embedded system 136 (FIG. 1). In other embodiments, the trip plan is generated by the control system generally using, for example, one or more embedded systems. Yet in other embodiments, the trip plan may be generated by the off-board system 154. Prior to the vehicle system 102 departing for the trip, the vehicle system 102 may also communicate with the GPS satellites 162 and/or the cell towers 164.

Vehicle information includes vehicle makeup information of the vehicle system 102, such as model numbers, manufacturers, horsepower, number of vehicles, vehicle weight, and the like, and cargo being carried by the vehicle system 102, such as the type and amount of cargo carried. Trip information includes information about the upcoming trip, such as starting and ending locations, station information, restriction information (such as identification of work zones along the trip and associated speed/throttle limitations), and/or operating mode information (such identification of speed limits and slow orders along the trip and associated speed/throttle limitations). Track information includes information about the track 106 along the trip, such as locations of damaged sections, sections under repair or construction, the curvature and/or grade of the track 106, global positioning system (GPS) coordinates of the trip, weather reports of weather experienced or to be experienced along the trip, and the like. The input information may be communicated to the vehicle system 102 prior to the vehicle system 102 departing from the starting location 150. The input information may also be communicated to the vehicle system 102 after the vehicle system 102 has departed from the starting location 150.

The input information may also include a temporary work order, if one exists, that designates a restricted segment of the route 104 (e.g., the beginning point and the end point of the segment), a speed limit through which the vehicle system 102 may travel through the restricted segment, and a limited time period in which the temporary work order is applied (e.g., 8:00 am-2:00 pm EST) to the restricted segment. As described above, the speed limit associated with the work order can be different than the speed limit associated with the same segment of the route before the work order was implemented.

As the vehicle system 102 moves along the route 104, the vehicle system 102 may communicate with other wireless communication systems. For example, the vehicle system 102 may communicate with the GPS satellites 162 and/or the cell towers 164. The GPS satellites 162 may provide location information, such as latitude and longitude coordinates, that can be used to identify the location of the vehicle system 102 along the route 104. The GPS satellites 162 may also provide time information. For instance, the GPS satellites may communicate a present time to the vehicle system 102 that is expressed in a predetermined time standard (e.g., UTC). The cell towers may provide location information and/or time information. For example, the cell towers may communicate the present time based on the predetermined time standard or based on a regional time standard of the geographical region in which the vehicle system 102 is presently located. The cell towers may also provide location information that can be used to identify where the vehicle system 102 is located within the geographical region. In some embodiments, the vehicle system 102 may uses information from GPS satellites and information from cell towers.

As illustrated in FIG. 2, the route 104 includes a restricted segment 140. For example, the input information used to generate the trip plan included a temporary work order that specified a beginning point 142 and an end point 144 of the restricted segment 140. The temporary work order may be issued by, for example, a government agency or railroad that communicates with the off-board system 154. The temporary work order also includes a maximum speed that is permitted to travel through the restricted segment 140 and a limited time period in which the temporary work order is active or valid.

The trip plan generated by the vehicle system 102 (or the off-board system 154) may also specify a monitoring segment 146. The monitoring segment 146 may represent a portion of the route 104 that includes the restricted segment 140. The monitoring segment 146 is greater or longer than the restricted segment 140. While moving through the monitoring segment 146, the vehicle system 102 may determine whether the temporary work order has expired. For example, the monitoring segment 146 includes a beginning point 148 and an end point 149. As the vehicle system 102 moves through the monitoring segment 146 between the beginning and end points 148, 149, the vehicle system 102 may continuously or periodically determine a current time that is based, at least in part, on communications with GPS satellites 162 and/or the cell towers 164. The vehicle system 102 may then determine whether the temporary work order has expired based on the current time and the limited time period. In some embodiments, the vehicle system 102 determines a location of the vehicle system 102 along the route and then determines the current time based on the location.

Yet in other embodiments, the trip plan does not identify a monitoring segment 146 or a beginning point 148. In such embodiments, the vehicle system 102 may continuously or periodically (e.g., every second or every minute) determine the current time and determine whether any upcoming restricted segments or restricted segments that the vehicle system 102 is presently moving through have expired. For example, the trip plan may specify twenty temporary work orders for the trip. The vehicle system 102 (e.g., the control system 100 or the first embedded system 136) may determine, for each of the temporary work orders in the trip plan or for each of the temporary work orders in an upcoming series of work orders (e.g., the next five restricted segments or all restricted segments within the next one hundred kilometers), whether the respective temporary work order has expired. If one or more of the temporary work orders have expired, the vehicle system 102 may generate another trip plan that removes speed restrictions for the restricted segment(s) associated with the expired work order(s). In some embodiments, the vehicle system 102 may communicate with the off-board system 154 to request updated input information prior to generating the other trip plan. In other embodiments, the vehicle system 102 may generate a new trip plan without receiving updated input information from the off-board system 154.

In some embodiments, the vehicle system 102 (or the control system) may modify the operational settings of the trip plan such that the vehicle system exceeds the maximum speed through the restricted segment. In such embodiments, the step of modifying the operational settings may occur prior to or as a new trip plan is generated. The step of modifying may include increasing the vehicle speed to a vehicle speed that is equal to or less than the speed limit when the temporary work order is not applied. For example, if the vehicle speed limit is 60 kph when the temporary work order is not applied, but 30 kph when the temporary work order is applied, the vehicle system 102 may increase the vehicle speed from 30 kph to 60 kph after determining that the temporary work order has expired. The vehicle system 102 may generate a new trip plan as the vehicle system 102 increases the vehicle speed or after the vehicle system 102 increases the vehicle speed.

As used in the detailed description and the claims, a trip plan may be generated before or after departure. During the trip, one or more new trip plans may be generated. When a new trip plan is implemented, the new trip plan becomes the existing trip plan or current trip plan and the next trip plan that is generated may be referred to as the new trip plan. For example, a new trip plan may be, numerically, the tenth trip plan generated by the vehicle system 102 during the trip between the starting location 150 and the final destination location 152. In this example, the ninth trip plan would be the "existing trip plan" or "current trip plan."

Also shown in FIG. 2, the route 104 includes another restricted segment 170 and monitoring segment 172. As described herein, the route 104 may include several restricted segments and, optionally, monitoring segments. The trip plan may be configured to control the vehicle system 102 so that the vehicle system 102 does not exceed the maximum speed through the restricted segment 170. However, due to delays along the trip, the temporary work order issued for the restricted segment 170 may expire prior to the vehicle system 102 entering the restricted segment 170 or as the vehicle segment moves through the restricted segment 170. Alternatively, due to the expiration of a temporary work order or temporary work orders, the vehicle system 102 may arrive at the restricted segment 170 sooner than predicted such that temporary work order for the restricted segment 170 is still valid. In such embodiments, the new trip plan may be configured to decrease the vehicle speed through the restricted segment 170 in order to satisfy the temporary work order.

Figure 3:
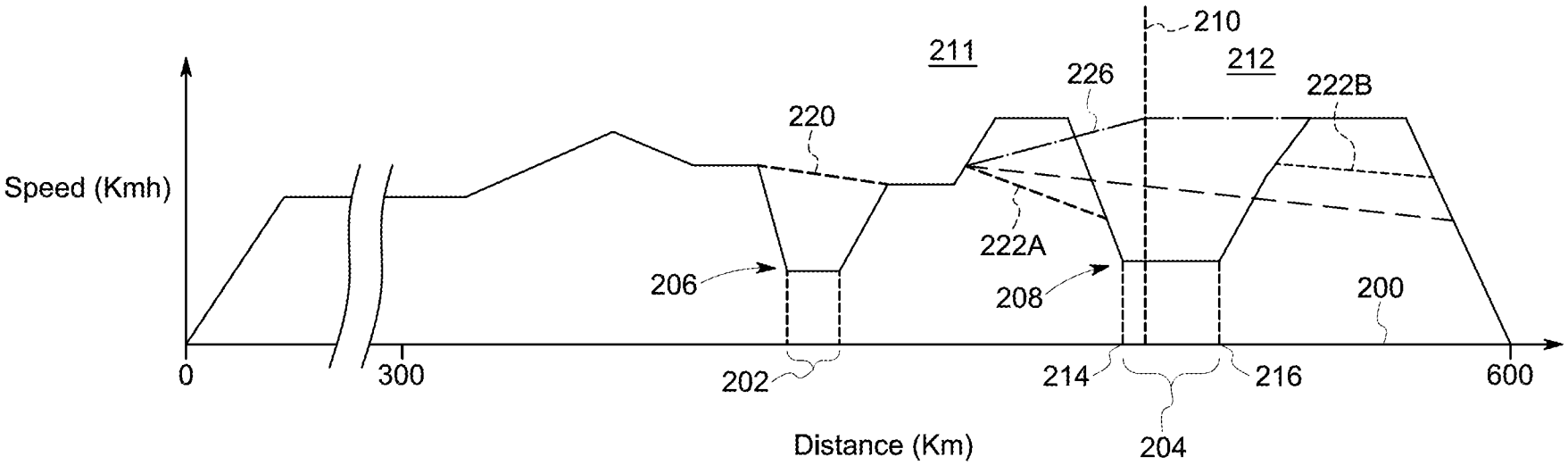
FIG. 3 illustrates a predicted speed profile of a trip and possible modifications to the speed profile based on when a temporary work order expires.
Figure 4:
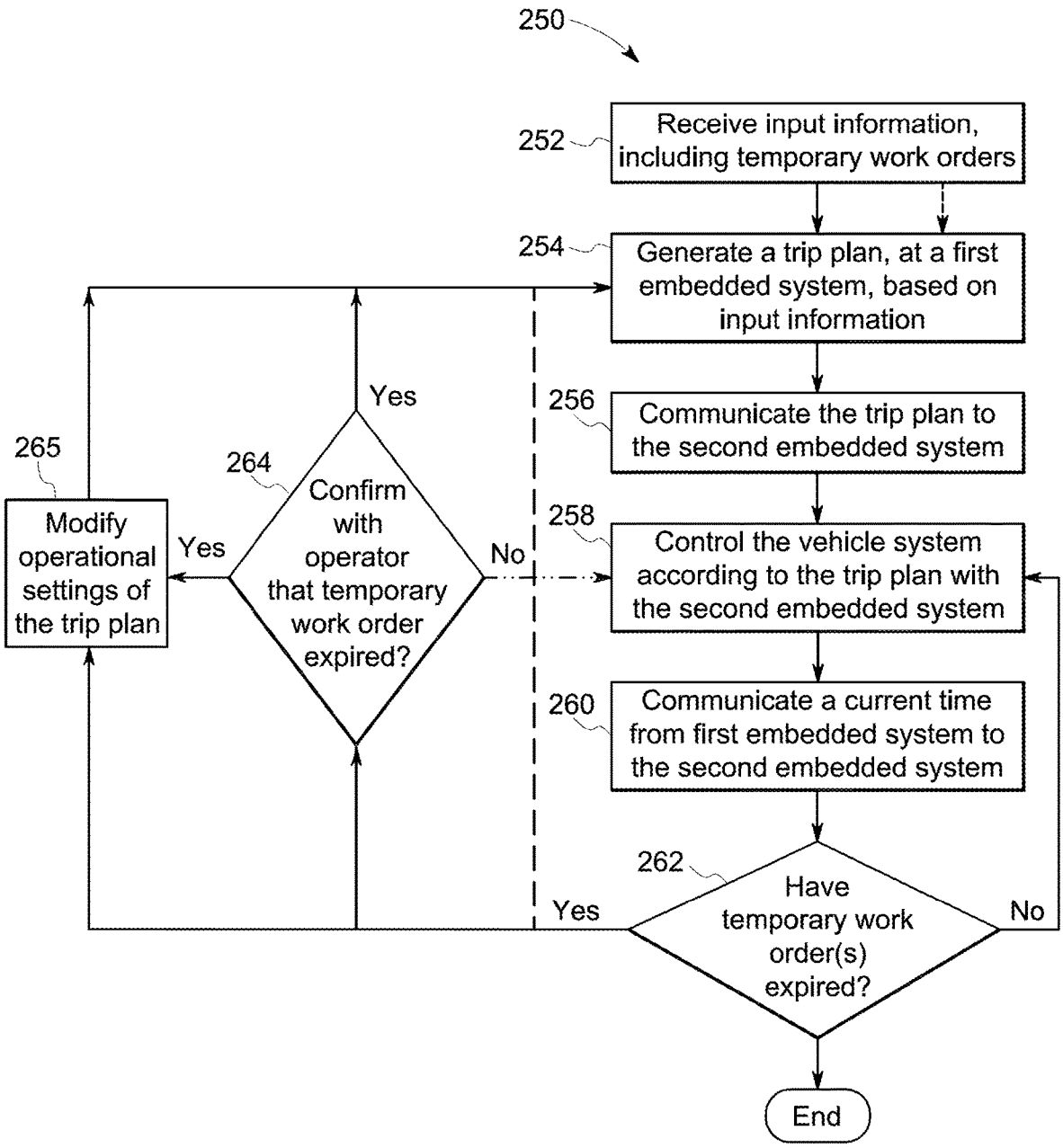
FIG. 4 is a flow chart illustrating a method (e.g., of operating a rail vehicle system) in accordance with an embodiment.

FIG. 3 illustrates a predicted speed profile (in solid lines) when a vehicle system begins a trip and possible changes to the speed profile (dashed lines) that may occur due to one or more temporary work orders expiring. The predicted speed profile may be determined by or based on the trip plan(s) that are generated for the route. FIG. 4 is a flow chart illustrating a method 250 (e.g., of operating a vehicle system) that is described with respect to the speed profile of FIG. 3. For illustrative purposes, FIG. 3 primarily shows the second half of the route between 300 km and 600 km. It should be understood, however, that the method 250 may be used throughout the route.

The horizontal axis in FIG. 3 between 0 km and 600 km represents the route 200. The route 200 includes restricted segments 202 and 204, but other restricted segments may exist in the first half of the route 200. Each of the restricted segments 202, 204 is associated with a temporary work order that specifies a maximum speed of a vehicle system moving through the restricted segment. The maximum speeds of the restricted segments 202, 204 are indicated at 206, 208, respectively. The vehicle system would be permitted to move through the restricted segments 202, 204 at greater vehicle speed if the temporary work orders did not exist or were expired. For example, the vehicle speed permitted when the temporary work order expires may be at least 1.5 times (1.5×) or at least 2 times (2×) the maximum speed specified by the temporary work order.

With respect to FIGS. 3 and 4, the method 250 may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

The method 250 is described as utilizing a first embedded system and a second embedded system. The first embedded system and the second embedded system may be separate embedded systems that are components of the same vehicle system. For example, the first and second embedded systems may be components of the same locomotive. Each of the first and second embedded systems may communicate with different components. Alternatively, the first and second embedded systems may communicate with at least one common component (e.g., wireless communication system or designated sensor). As one example, the first embedded system is a CMU and the second embedded system is a CCA.

Each of the first and second embedded systems may have a respective system clock that is independent of a time standard and also independent from each other. For example, the system clocks may be based on when the respective embedded system is started (e.g., booted or initialized). It is contemplated that the system clocks may be essentially synchronized by simultaneously starting the first and second embedded systems at the same time. The system clocks may also be synchronized by communicating with each other and modifying the time of at least one of the system clocks so that the two system clocks are essentially synchronized.

Each of the first and second embedded systems may utilize their respective system clock during operation. For example, the first embedded system may record data and/or log events in a recorder in which the times logged are determined by the system clock of the first embedded system. Likewise, the second embedded system may utilize its system clock while implementing the trip plan and/or other functions of the second embedded system.

The method 250 includes receiving, at 252, input information for generating a trip plan. The input information may include data for generating a trip plan, such as those described above, and one or more temporary work orders. The input information may be received from a single source, such as a single off-board system, or from multiple sources. In addition to the off-board system, the sources may include an onboard component of the vehicle system. For example, the source may be a database that provides vehicle information (e.g., weight, number of cars) or a sensor that provides information on an operating condition. In an exemplary embodiment, the input information may be received, at 252, by the first embedded system or, more generally, the control system. In other embodiments, however, the off-board system may receive the input information to generate the trip plan remotely.

At 254, a trip plan may be generated that is based on (or a function of) the input information, including the temporary work orders. The trip plan may be generated prior to departure. The trip plan, however, may also be generated after departure. In an exemplary embodiment, the trip plan is generated by the first embedded system. More specifically, the first embedded system may analyze the input information and use one or more algorithms to generate a trip plan. The trip plan dictates or provides tractive settings and braking settings to be implemented by the vehicle system moving along the route. In addition to the settings, the trip plan may include at least one of a predicted speed profile, a predicted trip duration, a predicted arrival time at the final destination, a predicted fuel consumption, or predicted fuel emissions (e.g., for the entire route or for a portion of the route that remains after a designated point along the route). Alternatively, the trip plan may include information that is sufficient for calculating the predicted speed profile, the predicted trip duration, the predicted arrival time at the final destination, the predicted fuel consumption, and/or the predicted fuel emissions. The predicted speed profile may be similar or identical to the predicted speed profile shown in FIG. 3.

As described above, the trip plan may also be based on one or more temporary work orders issued for restricted segments along the route, such as the restricted segments 202, 204. The trip plan may be based on ten, twenty, thirty, or more temporary work orders in which each temporary work order provides a maximum speed through the restricted segment and a limited time period in which the maximum speed restriction is implemented. The limited time period may be expressed using a designated time standard. The designated time standard may be, for example, UTC or a regional time standard of the geographical region that includes the restricted segment.

The trip plan may be based on temporary work orders that are located in different time zones. In some cases, a temporary work order may correspond to a restricted segment that extends through a boundary between two different time zones. For example, a line 210 is shown in FIG. 3 that indicates a boundary between first and second time zones 211, 212. The restricted segment 204 extends through each of the first and second time zones 211, 212 such that portions of the restricted segment 204 are located in different time zones. More specifically, a beginning point 214 of the restricted segment 204 is located within the first time zone 211, and an end point 216 of the restricted segment 204 is located within the second time zone 212. As such, in some embodiments, the trip plan includes limited time periods that are expressed in different time standards (e.g., EST, central time standard (CST), mountain standard time (MST), etc.). Although the examples provided are in the United States, it should be understood that the restricted segments may exist in other countries that use different time standards.

After generating the trip plan, at 254, the trip plan may be communicated, at 256, to the vehicle system or the control system. If the trip plan was generated, at 256, by the vehicle system, the trip plan may be communicated to the designated embedded system (e.g., the second embedded system). Optionally, the system that generates the trip plan, at 254, may also control operation of the vehicle system in accordance with the trip plan. In such alternative embodiments, the step of communicating the trip plan, at 256, is not necessary to perform.

The vehicle system is controlled, at 258, according to the trip plan. In particular embodiments, the second embedded system receives the trip plan from the first embedded system and implements the trip plan by, at least in part, controlling operation of traction motors and braking subsystems.

At 260, a current time may be communicated to the system (e.g., control system or second embedded system) that is controlling the vehicle system. In the illustrated embodiment, the current time is communicated from the first embedded system to the second embedded system. In some embodiments, the current time may be communicated only upon request from the system that is controlling the vehicle system. In other embodiments, the current time may be continuously or periodically sent by the first embedded system without a request from the second embedded system.

The current time may be expressed in a designated time standard (e.g., UTC) or expressed in a regional time standard of the geographical region that includes the restricted segment. For embodiments in which the current time is expressed in the regional time standard, the current time is referred to as the local time. As one example, the first embedded system may communicate that the current time is 13:25 UTC or, alternatively, the first embedded system may communicate that the local time is 10:25 EST (if the regional time standard is EST).

For embodiments in which the current time is expressed in the regional time standard, the current time may be converted into the regional time standard by the control system. In particular embodiments, the current time is converted into the regional time standard by the first embedded system. For example, the first embedded system may be configured to communicate wirelessly with a remote system, such as a GPS satellite or a cell tower. The first embedded system may receive time data and location data from the remote system. The time data may correspond to the current time in the designated time standard (or other known time standard). The first embedded system may continuously or periodically (e.g., every second, every five seconds, every ten seconds, etc.) receive time data and location data from the remote system. Alternatively, the first embedded system may request the time data and location data from the remote system at designated events, such as receiving a request for the current time from the second embedded system.

As such, the current time may be communicated from the remote system to the first embedded system. The location data may be used to identify where the vehicle system is located at the current time. For example, the GPS satellite may communicate current time and latitude and longitude coordinates to the first embedded system. The first embedded system may include a database that defines a path of the route in latitude and longitude coordinates. The first embedded system may compare the latitude and longitude coordinates from the GPS satellite to the latitude and longitude coordinates in the database to identify a location of the vehicle system at the current time. This location may be referred to as the current location or present location.

Using the current location, the first embedded system may be configured to determine a regional time standard of the geographical region that includes the restricted segment. With the current time known in the designated time standard (e.g., UTC), the first embedded system may convert the current time in the designated time standard to a current time (or local time) in the regional time standard. The local time may be communicated from the first embedded system to the second embedded system. As described below, the second embedded system (or the control system) may use the local time to determine if a temporary work order has expired.

Yet in other embodiments, the system that is controlling operation of the vehicle system may communicate directly with the remote system. For example, the second embedded system may be configured to communicate with a GPS satellite and/or cell tower to determine the current time and location of the vehicle system. The second embedded system may then convert the current time into a local time, if necessary, using the process described above with respect to the first embedded system.

The current time may be communicated to the second embedded system as the vehicle system approaches a restricted segment or as the vehicle system moves through the restricted segment. For example, it may be possible that a temporary work order expires while the vehicle system is located within the restricted segment. In some embodiments, the current time is continuously or periodically received by the second embedded system (or the control system). In other embodiments, the second embedded system may request the current time from the first embedded system at a designated point along the route. For example, the trip plan may identify when to request the current time from the first embedded system.

In some embodiments, the second embedded system may maintain a current clock in addition to the system clock. The current clock may have a time that is kept by the second embedded system and that is based on a previously-determined offset with respect to the system clock of the second embedded system. Such embodiments may be useful when vehicle systems are located in dead zones where wireless communication with remote system has failed or is not reliable. More specifically, prior to arriving at a restricted segment, the second embedded system may receive a current time. The second embedded system may determine that system clock is offset with respect to the current time by a designated value. The designated value may be, for example, in seconds or minutes. With the offset known, the second embedded system may be able to determine a current time. Similar to above, it may be necessary to modify the offset when crossing multiple time zones.

At 262, the second embedded system (or the control system) may query whether the temporary work order of an approaching restricted segment has expired or whether the temporary work orders of approaching restricted segments have expired. For example, the second embedded system may analyze all the remaining temporary work orders or a select number of temporary work orders. The select number may be, for example, a series of temporary work orders (e.g., the next five temporary work orders) or the temporary work orders located within a designated distance (e.g., any work orders for restricted segments in the next 100 km).

As described above, the trip plan may specify the limited time period in which a temporary work order is valid. Alternatively, the control system may receive information indicating when the work order terminates without use of the trip plan. For example, the input information received by the control system may indicate the time(s) that the work order is valid and/or an indication of whether the work order is currently valid and in-force without the control system having to resort to use of the trip plan to determine whether a work order is valid.

Using the current time (or local time), the second embedded system may determine whether the temporary work order has expired. If the temporary work order has expired (or subsequent temporary work orders have expired), the method may at least one of (1) generate, at 254, a new trip plan, (2) prompt or query, at 264, the human operator to confirm that the temporary work order has expired, or (3) modify, at 265, the operational settings of the trip plan such that the vehicle system exceeds the maximum speed through the restricted segment. In some embodiments, the method may perform more than one of the above steps. For example, after determining that the temporary work order has expired, the operator may be prompted or queried to confirm that the temporary work order has expired. Upon receiving confirmation from the operator, the operational settings are modified to increase the vehicle speed. As the vehicle speed is increased, a new trip plan may be generated. As another example, after determining that the temporary work order has expired, the operational settings may be automatically modified to increase the vehicle speed. As the vehicle speed is increased, a new trip plan may be generated. Yet in another example, after determining that the temporary work order has expired, a new trip plan may be generated. The last example may be performed when, for instance, a subsequent temporary work order has expired.

If the temporary work order has not expired, the method 250 may return to controlling the vehicle system, at 258, according to the trip plan. If the second embedded system determines that the temporary work order has expired, but the human operator does not confirm the expiration of the temporary work order, the method 250 may return to controlling the vehicle system, at 258, according to the trip plan.

As described herein, the method 250 may automatically generate a new trip plan, at 254, in response to determining that the temporary work order (or temporary work orders) has expired. This automatic path is indicated by the dashed line between the query 262 and the block 254. It should be understood, however, that both paths may be taken. For example, after determining that the temporary work order has expired, the method 250 may ask the human operator, at 264, whether the temporary work order has expired and also automatically instruct the control system (or first embedded system) to begin generating a new trip plan.

When the control system asks the human operator, at 264, to confirm that the temporary work order has expired, the control system may display the temporary work order (or orders) on a user interface (e.g. user display, screen, touch-screen, or the like) that is disposed onboard the vehicle system. For example, the second embedded system may identify the temporary work order by an order number or by mile markers. The second embedded system may also display the limited time period for the temporary work order. The human operator may then determine whether the temporary work order has expired. The human operator may also communicate remotely to determine whether the temporary work order has expired.

When a new trip plan is generated, at 254, the first embedded system (or the control system) may generate a new trip plan in which the vehicle system exceeds the maximum speed through the restricted segment with the expired work order. Returning to FIG. 3, the restricted segment 202 includes an alternative speed profile in which the vehicle system exceeds the maximum speed 206. This vehicle speed is referenced at 220. Because the vehicle system was permitted to exceed the maximum speed for the restricted segment 202, the vehicle system may have a different speed profile for a remainder of the trip.

At 254, the new trip plan may be created to achieve one or more objectives. For example, the new trip plan may be configured to have at least one of (a) a new predicted trip duration that is essentially equal to the prior predicted trip duration or (b) a new predicted fuel consumption that is less than the predicted fuel consumption from the prior trip plan. In some embodiments, a trip duration is essentially equal to another trip duration if the trip durations are within 5% of each other. For example, if the trip duration of the original plan was 8 hours, the trip duration of the new trip plan is essentially equal to the original trip duration if the new trip duration is eight hours +/−24 minutes. In more particular embodiments, a trip duration is essentially equal to another trip duration if the trip durations are within 3% of each other or within 2% of each other. In some embodiments, a trip duration is essentially equal to another trip duration if the trip durations are within 15 minutes of each other. In more particular embodiments, a trip duration is essentially equal to another trip duration if the trip durations are within 10 minutes of each other or within 5 minutes of each other. Optionally, the new trip plan may have a slower average vehicle speed after the restricted segment compared to the average vehicle speed of the prior trip plan after the restricted segment.

When the new trip plan is generated, at 254, the control system (or the first embedded system) may use only the prior trip plan and the new information that the temporary work order has expired. In other embodiments, the control system may use updated input information. For example, the first embedded system may communicate with a remote system (e.g., off-board system) that provides information that has changed since the last communication between the first embedded system and the remote system. The new or updated information is represented by the dashed arrow in FIG. 3.

FIG. 3 also illustrates how the predicted speed profile may change in the new trip plan after determining that the temporary work order for the restricted segment 202 had expired. Three alternative profiles are shown. A first alternative (indicated at 222A, 222B) may be implemented if the temporary work order for the restricted segment 204 remains valid during the trip. At 222A, the vehicle system may coast toward the restricted segment 204. At 222B, the vehicle system may have a decreased speed for a portion of the route 200 because the vehicle system was permitted to travel at a greater vehicle speed through the restricted segment 202. In this example, the trip duration may be essentially equal and the fuel consumption during the trip may be less.

The portion of the speed profile referenced at 224 indicates a speed profile in which the temporary work order for the restricted segment 204 has expired. In this example, the speed of the vehicle system may gradually decrease as the vehicle system approaches the final destination. The portion of the speed profile referenced at 226 indicates another speed profile in which the temporary work order for the restricted segment 204 has expired. In this example, the speed of the vehicle system is greater to allow the vehicle system to arrive at the final destination earlier or to allow the vehicle system to make up for delays that occurred during the first half of the route.

In one embodiment, the control system onboard a vehicle system can dictate the operational settings to be implemented by the vehicle system during movement that approaches, passes through, and/or exits a route segment associated with one or more work orders. The control system can dictate these operational settings by automatically controlling the propulsion system and/or brake system of the vehicle system such that the vehicle system moves according to or in congruence with the operational settings. These operational settings can be part of the trip plan described above, can be determined based on manual input provided by the operator of the vehicle system, and/or can be automatically determined by the control system. For example, the control system can determine the speed limit of the route (whether reduced by the work order or not), the distance to other vehicles and/or objects on the route, the weather conditions, etc., and can generate the operational settings to ensure that the vehicle system does not violate the speed limit, collide with another object or vehicle, and travels at a safe speed based on the weather conditions, without having access to or creating any trip plan.

The control system can determine at least some of the operational settings based on a transitory speed limit of the segment of the route that is associated with or under the purview of the temporary work order. The speed limit is transitory in that the speed limit is only applicable while the work order is valid, in-force, or otherwise enforceable. For example, prior to the start of a work order, the route segment may have a first speed limit. Upon the starting time of the work order, the speed limit of the route segment may be reduced from the first speed limit to a slower, second speed limit. This second speed limit can be in-force during the work order. Upon expiration or termination of the work order, the speed limit of the route segment may increase to the first speed limit. The speed limits may be "in-force" when the vehicle systems are automatically prevented from traveling faster than the speed limits, when moving faster than the speed limits violates a law or regulation, or when the operator and/or owner of the vehicle system agrees to not move the vehicle system faster than the speed limits.

As described above, the control system determines whether the work order is currently applicable by determining and comparing a current time with the start time and/or end time of the work order. If the current time falls within the start time and end time, then the control system determines that the work order (and any applicable associated speed limits of the work order) is in-force. For example, if the current time is after the start time of the work order but before the end time of the work order, then the control system determines that the reduced speed limit of the route segment is enforceable and the faster speed limit of the route segment before the work order is not enforceable. The control system can determine and compare the current time to the time period of the work order as the vehicle system approaches and/or travels within the route segment associated with the work order.

The control system can perform or direct implementation of one or more responsive actions in response to determining and comparing the current time with the time period of the work order. For example, the control system can determine whether the transitory speed limit of the work order has started, whether the transitory speed limit of the work order is still in effect (e.g., is still in-force or enforceable), and/or whether the transitory speed limit of the work order has expired based on the comparison of the current time to the time period of the work order. The control system can generate and/or direct an output device (e.g., an electronic display, a light, a speaker, or the like) to generate a prompt indicating that the work order is in-force, has not yet started, or has terminated, as applicable. For example, if the vehicle system is approaching and/or traveling within the route segment associated with the work order and the control system determines that the work order has started but has not yet expired, the control system can generate a prompt that notifies the operator of the vehicle system that the vehicle system is approaching and/or traveling within the route segment having the reduced speed limit of the work order. As another example, if the vehicle system is approaching and/or traveling within the route segment associated with the work order and the control system determines that the work order has not yet started or has expired, the control system can generate a prompt that notifies the operator of the vehicle system that the vehicle system is approaching and/or traveling within the route segment having the faster speed limit than the reduced speed limit of the work order. Stated differently, the control system can notify the operator that the work order has ended or not yet started.

The expiration of a work order can occur while the vehicle system is traveling in the route segment associated with the work order. For example, the vehicle system may enter the route segment having the reduced speed limit of the work order after the work order has started but prior to termination of the work order. The work order may terminate before the vehicle system has left this route segment.

If the work order having the reduced speed limit has expired (before the vehicle system enters the route segment of the work order or while the vehicle system moves in this route segment), the control system can control the propulsion and/or braking systems of the vehicle system to increase the speed of the vehicle system above the reduced speed limit of the work order while the vehicle system propels itself through the route segment of the expired work order.

For example, the vehicle system may enter into a route segment having a currently enforceable work order with a reduced speed limit. The control system can automatically control the movement of the vehicle system to move no faster than the reduced speed limit. This can occur by the control system automatically setting the throttle settings, brake settings, power outputs of the propulsion system, etc., and/or by the control system disregarding or changing manual inputs from the operator that would cause the vehicle system to travel faster than the reduced speed limit of the work order. Before the vehicle system exits the route segment of the work order, the work order may expire or no longer be enforceable. The vehicle system can then automatically control the vehicle system to speed up to a speed that is faster than the reduced speed limit of the expired work order such that the vehicle system moves faster than the reduced speed limit of the expired work order in the route segment of the expired work order. The control system optionally can control the vehicle system to move no faster than the current, faster speed limit of the route segment (e.g., faster than the speed limit of the work order).

The route segment associated with a work order may have more than one vehicle system on or in the route segment. For example, a long route segment having a currently in-force work order may have two or more separate vehicle systems traveling in the same direction on the same route segment. If the work order expires while these vehicle systems are in the route segment, the control systems of the vehicle systems can communicate (unidirectionally and/or bi-directionally) to avoid collision between the vehicle systems. The trailing vehicle system may determine that the work order has expired before the leading vehicle system. Optionally, the trailing vehicle system may accelerate faster to the increased speed limit of the route segment (now that the reduced work order speed limit has expired) than the leading vehicle system. The control system of the trailing vehicle system can communicate with the control system of the leading vehicle system to avoid a collision between the vehicle systems.

For example, the control system of the trailing vehicle system (referred to as the trailing control system) can communicate a signal to the control system of the leading vehicle system (referred to as the leading control system) to notify the leading control system that the work order has expired and the leading vehicle system can speed up to speeds above the reduced speed limit of the expired work order. As another example, the trailing control system can communicate with the leading control system to determine the location and/or moving speed of the leading vehicle system in response to determining that the work order has expired. The trailing control system can then control movement of the trailing vehicle system to avoid the trailing vehicle system overtaking and colliding with the leading vehicle system.

A route segment can have multiple work orders in place at the same time. This can be referred to as a multi-order route segment. Different work orders can have different reduced speed limits. For example, a route segment can have two different work orders that are concurrently in force. A first work order can be associated with a first reduced speed limit (that is slower than the speed limit of the route segment without any work orders) and a second work order can be associated with a slower, second reduced speed limit (that is slower than the first reduced speed limit). These work orders can be associated with different start and/or end times such that one work order may be in-force for a first time period, then multiple work orders may be in-force at the same time for a subsequent second time period, then one or more of the work orders may have expired while one or more other work orders remain in-force for a subsequent third time period.

The control system can determine the locations, start times, and end times for the work orders associated with the multi-order route segment. The control system can then determine and compare the location of the vehicle system and the time with the locations and times of the work orders. The control system can identify which work orders are applicable and in-force based on the location of the vehicle system and the time. If the work orders do not have the same reduced speed limit, the control system can identify the most restrictive (e.g., slowest) of the applicable speed limits and control the vehicle system to move no faster than the slowest speed limit. Once one of the work orders expires, the control system can determine which of the multiple work orders remain in-force based on the location of the vehicle system and time. The control system can then determine the most restrictive speed limit of the remaining work orders that are in-force and restrict movement of the vehicle system to travel no faster than this speed limit.

In one embodiment, temporal period of a work order can be based on one or more other factors. A work order can start and/or stop based on a holiday schedule. For example, some holidays are associated with increased travel of vehicle systems on routes. A work order can be implemented to start at a date and/or time when route traffic increases for a holiday and to end at a date and/or time when route traffic decreases after the holiday. As another example, some days of the week are associated with increased travel of vehicle systems on routes. A work order can be implemented to start on days associated with increased route traffic and to end before days associated with reduced route traffic. For example, a work order can be implemented to reduce the speed limit for a route or route segment on Mondays, Tuesdays, and Fridays, but not be implemented on other days of the week.

As another example, a work order can be in-force during times associated with increased travel of vehicle systems on routes. For example, a work order can be implemented during rush hours of an urban area to reduce the speed limit of routes. The work order can be eliminated or not in-force before and after the rush hours.

A work order can be in-force during dynamically changing times. For example, work orders can be implemented to reduce the speed limits of route segments based on changing traffic patterns. That is, instead of or in addition to starting and stopping of a work order being fixed to designated days or times (which can be determined based on historical evidence), the work orders can be implemented responsive to traffic congestion increasing above a designated threshold and terminated responsive to traffic congestion decreasing to or below the threshold.

As another example, work orders can be implemented during increased power consumption times and terminated after increased power consumption times end. The power consumption can be the electric current that is supplied to the propulsion systems of vehicle systems, such as from an overhead catenary, a powered rail, etc. The vehicle systems can include corresponding devices, such as pantographs, conductive shoes or brushes, or the like, for drawing electric current from the catenary, powered rail, etc., to power motors and/or other loads of the vehicle systems. Certain times of the day may be associated with increased demands for electric current. For example, times during which both businesses and residential buildings are drawing more current from a utility grid than other times can be peak demand times. In one embodiment, a work order may be implemented during peak demand times. This can reduce the speed limit (and, therefore, reduce the current drawn by vehicle systems from the grid) during peak demand times to reduce the current drawn from the grid (relative to not implementing the work order).

As another example, a work order can be implemented during certain weather conditions. A work order can be implemented responsive to a weather alert indicating reduced visibility (e.g., fog) or other hazardous conditions (e.g., high winds, significant precipitation, significant accumulation of snow and/or ice, tornadic activity, hurricanes, etc.). This can force vehicle systems to reduce speeds for safer travel during the adverse weather conditions.

The work orders can optionally cause or direct the vehicle systems to change operations in addition to or in place of changing speeds. For example, a control system can change an operation of a vehicle system other than speed in response to determining that the location and time indicates that the vehicle system is moving within a route segment associated with an in-force work order. The other operations that can be changed can include emissions generated by the vehicle system, fuel consumed (or a rate of fuel consumption) by the vehicle system, the type of fuel consumed by the vehicle system, acoustic sound generated by the vehicle system, activation of lights or other devices, etc. For example, a work order may restrict the amount of emissions generated by a vehicle system. Responsive to entering into a route segment subject to a work order, the control system can change throttle settings, brake settings, or the like, to reduce the amount of emissions generated by the vehicle system while traveling subject to the work order. This can allow for emissions-based work orders to be used in areas having increased emissions and/or tighter restrictions on emission generation (than other locations not associated with such a work order).

As another example, a work order may restrict the amount of fuel consumed and/or the rate of fuel consumed by a vehicle system. Responsive to entering into a route segment subject to a work order, the control system can change throttle settings, brake settings, or the like, to reduce the amount of fuel consumed and/or the rate at which fuel is consumed by the vehicle system while traveling subject to the work order. This can allow for fuel-based work orders to be used to reduce fuel consumption by vehicle systems.

As another example, a work order may restrict the type of fuel consumed by a vehicle system. Responsive to entering into a route segment subject to a work order, the control system onboard a hybrid vehicle system capable of consuming different fuels for propulsion can change which of the fuels is being consumed. Such a vehicle system can switch from consuming diesel fuel to natural gas, from consuming a liquid or gaseous fuel to being powered by electric energy stored in batteries, or between two other types of fuel or energy.

In another example, a work order may restrict the acoustic sounds generated by a vehicle system. Responsive to entering into a route segment subject to such a work order, the control system onboard a vehicle system can prevent the vehicle system from operating in certain states to reduce the noise generated by the vehicle system. For example, the control system can prevent the vehicle system from using dynamic braking, from operating at higher throttle settings, or the like, to reduce the noise generated by the vehicle system (relative to traveling in locations not subject to such a work order).

As another example, a work order may require the vehicle system to activate lights of the vehicle system during travel in the route segment under the work order. Responsive to entering into a route segment subject to such a work order, the control system onboard the vehicle system can automatically activate headlights of the vehicle system. These types of work orders can be implemented at night, during adverse weather conditions (e.g., fog, heavy precipitation, etc.), or the like.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims. The various embodiments are not limited to the arrangements and instrumentality shown in the drawings.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A control system for a vehicle system having one or more propulsion vehicles moving along a route under a first speed limit, the control system configured to:

dictate operational settings to be implemented by the one or more propulsion vehicles based at least in part on a transitory second speed limit that is less than or equal to the first speed limit and which is issued for a determined segment of the route and for a determined time period, the time period having a start time and a stop time;

obtain a current time as the one or more propulsion vehicles approaches, enters, or moves through the determined segment;

determine whether the transitory second speed limit has started, is in effect, or has expired based on the current time relative to the determined time period; and in response to such determination, perform one or more of:

generate a prompt to indicate that the determined time period has expired, operate the one or more propulsion vehicles at the first speed limit, or modify the operational settings of the one or more propulsion vehicles to exceed the second speed limit in the determined segment but not exceed the first speed limit for the determined segment.

2. The control system of claim 1, wherein the control system is configured to dynamically modify the operational settings of the one or more propulsion vehicles while the one or more propulsion vehicles is moving within the determined segment responsive to determining that the determined time period expired while the one or more propulsion vehicles moves in the determined segment.

3. The control system of claim 1, wherein the control system also is configured to communicate a signal to one or more other vehicle systems also traveling within the determined segment, the signal notifying the one or more other vehicle systems of expiration of the determined time period of the transitory second speed limit.

4. The control system of claim 3, wherein the control system is configured to communicate the signal that instructs the one or more other vehicle systems to speed up for avoiding collision between the one or more propulsion vehicles and the one or more other vehicle systems.

5. The control system of claim 1, wherein the control system also is configured to:

dictate the operational settings to be implemented by the one or more propulsion vehicles based at least in part on a transitory third speed limit that is less than or equal to the second speed limit and which is issued for at least part of the determined segment of the route and for at least part of the determined time period;

determine whether the transitory third speed limit has started, is in effect, or has expired; and in response to such determination, perform one or more of:

generate another prompt to indicate that the transitory third speed limit has expired, operate the one or more propulsion vehicles at the first speed limit or the second speed limit, or modify the operational settings of the one or more propulsion vehicles to exceed the third speed limit but not the second speed limit in the determined segment.

6. The control system of claim 1, wherein the determined time period of the transitory second speed limit is based on one or more of a holiday schedule, a peak demand time of a utility grid, a traffic rush hour, or one or more weather conditions.

7. The control system of claim 1, wherein the control system is configured to also modify one or more of the operational settings of the one or more propulsion vehicles other than a throttle setting or a brake setting of the one or more propulsion vehicles based on determining that the transitory second speed limit is in effect.

8. The control system of claim 7, wherein the one or more operational settings other than the throttle setting or the brake setting include one or more of activation of a light of the one or more propulsion vehicles, an amount of emissions generated by the one or more propulsion vehicles, a type of fuel or energy consumed by the one or more propulsion vehicles, or an amount of acoustic noise generated by the one or more propulsion vehicles.

9. The control system of claim 1, wherein the control system also is configured to receive one or more positive vehicle control signals and perform the one or more of generate the prompt, operate the one or more propulsion vehicles, or modify the operational settings based on the one or more positive vehicle control signals that are received.

10. The control system of claim 1, wherein the control system is further configured to:

store the transitory second speed limit issued for the determined segment of the route and for the determined time period, and store the first speed limit or another speed limit for the determined segment of the route for at least one of before the start time or after the stop time.

11. A method comprising:

determining operational settings to be implemented by a vehicle system having one or more propulsion vehicles moving along a route under a first speed limit, the operational settings determined based at least in part on a transitory second speed limit that is less than or equal to the first speed limit and which is issued for a determined segment of the route and for a determined time period, the time period having a start time and a stop time;

obtaining a current time as the one or more propulsion vehicles approaches, enters, or moves through the determined segment;

determining whether the transitory second speed limit has started, is in effect, or has expired based on the current time relative to the determined time period; and in response to such determination, performing one or more of:

generating a prompt to indicate that the determined time period has expired, operating the one or more propulsion vehicles at the first speed limit, or modifying the operational settings of the one or more propulsion vehicles to exceed the second speed limit in the determined segment but not exceed the first speed limit for the determined segment.

12. The method of claim 11, wherein the operational settings are dynamically modified while the one or more propulsion vehicles is moving within the determined segment responsive to determining that the determined time period expired while the one or more propulsion vehicles moves in the determined segment.

13. The method of claim 11, further comprising:

communicating a signal to one or more other vehicle systems also traveling within the determined segment, the signal notifying the one or more other vehicle systems of expiration of the determined time period of the transitory second speed limit.

14. The method of claim 11, further comprising:

determining the operational settings to be implemented by the one or more propulsion vehicles based at least in part on a transitory third speed limit that is less than or equal to the second speed limit and which is issued for at least part of the determined segment of the route and for at least part of the determined time period;

determining whether the transitory third speed limit has started, is in effect, or has expired; and in response to such determination, performing one or more of:

generating another prompt to indicate that the transitory third speed limit has expired, operating the one or more propulsion vehicles at the first speed limit or the second speed limit, or modifying the operational settings of the one or more propulsion vehicles to exceed the third speed limit but not the second speed limit in the determined segment.

15. The method of claim 11, wherein the determined time period of the transitory second speed limit is based on one or more of a holiday schedule, a peak demand time of a utility grid, a traffic rush hour, or one or more weather conditions.

16. The method of claim 11, wherein modifying the operational settings includes modifying one or more of the operational settings of the one or more propulsion vehicles other than a throttle setting or a brake setting of the one or more propulsion vehicles based on determining that the transitory second speed limit is in effect.

17. The method of claim 16, wherein the one or more operational settings other than the throttle setting or the brake setting include one or more of activation of a light of the one or more propulsion vehicles, an amount of emissions generated by the one or more propulsion vehicles, a type of fuel or energy consumed by the one or more propulsion vehicles, or an amount of acoustic noise generated by the one or more propulsion vehicles.

18. The method of claim 11, further comprising:

receiving one or more positive vehicle control signals; and performing the one or more of generate the prompt, operate the one or more propulsion vehicles, or modify the operational settings based on the one or more positive vehicle signals that are received.

19. A system comprising a control system that is configured to:

determine operational settings to be implemented by a vehicle system having one or more propulsion vehicles moving along a route, the operational settings determined based on a temporary work order issued for a restricted segment of the route, the temporary work order providing a reduced speed limit for travel through the restricted segment for a defined time period, wherein one or more of the operational settings specify movement of the one or more propulsion vehicles through the restricted segment at a vehicle speed that is less than or equal to the reduced speed limit;

control the one or more propulsion vehicles in accordance with the operational settings as the one or more propulsion vehicles moves along the route to travel within the restricted segment at the vehicle speed that is less than or equal to the reduced speed limit;

determine a current time as the one or more propulsion vehicles moves through the restricted segment;

determine that the temporary work order has expired based on the current time and the defined time period of the temporary work order; and in response to determining that the temporary work order has expired, prompt an operator of the one or more propulsion vehicles to confirm that the temporary work order has expired or determine updated operational settings to be implemented by the one or more propulsion vehicles to move faster than the reduced speed limit in the restricted segment.

20. The system of claim 19, wherein the control system also is configured to communicate a signal to one or more other vehicle systems also traveling within the restricted segment, the signal notifying the one or more other vehicle systems of expiration of the temporary work order.

21. The system of claim 19, wherein the control system also is configured to:

dictate the operational settings to be implemented by the one or more propulsion vehicles based at least in part on a transitory third speed limit that is less than or equal to the reduced speed limit and which is issued for at least part of the restricted segment of the route and for at least part of the defined time period;

determine whether the transitory third speed limit has started, is in effect, or has expired; and in response to such determination, perform one or more of:

generate another prompt to indicate that the transitory third speed limit has expired, operate the one or more propulsion vehicles at the third speed limit, or modify the operational settings of the one or more propulsion vehicles to exceed the third speed limit but not the reduced speed limit in the restricted segment.

* * * * *